US009617772B1

(12) United States Patent
Chen

(10) Patent No.: US 9,617,772 B1
(45) Date of Patent: Apr. 11, 2017

(54) HINGE ASSEMBLAGE

(71) Applicants: Waterson Corp., Taichung (TW); Waterson Chen, Taichung (TW); Yin-Chu Chen, Taichung (TW)

(72) Inventor: Waterson Chen, Taichung (TW)

(73) Assignees: Waterson Corp, Taichung (TW); Waterson Chen, Taichung (TW); Yin-Chu Chen, Taichung (TW)

( * ) Notice: Subject to any disclaimer, the term of this patent is extended or adjusted under 35 U.S.C. 154(b) by 0 days.

(21) Appl. No.: 15/150,475

(22) Filed: May 10, 2016

(51) Int. Cl.

| | |
|---|---|
| ***E05F 3/20*** | (2006.01) |
| ***E05D 3/02*** | (2006.01) |
| ***E05F 3/14*** | (2006.01) |
| ***E05F 1/10*** | (2006.01) |

(52) U.S. Cl.
CPC ..... *E05F 3/20* (2013.01); *E05D 3/02* (2013.01); *E05F 1/1016* (2013.01); *E05F 3/14* (2013.01); *E05Y 2900/132* (2013.01); *Y10T 16/2771* (2015.01)

(58) Field of Classification Search
CPC ... E05F 3/20; E05F 1/1016; E05F 3/14; E05F 3/12; E05F 5/02; E05F 1/1215; E05D 3/02; E05D 11/08; E05D 11/1078; E05Y 2900/132; Y10T 16/2771; Y10T 16/304; Y10T 16/61; Y10T 16/625; Y10T 16/599; Y10T 16/540255; Y10T 16/5387; Y10T 16/5386; F16F 9/10
USPC ..... 16/54, 50, 82, 85, 75, 330, 303, 298; 188/322.5, 290
See application file for complete search history.

(56) References Cited

U.S. PATENT DOCUMENTS

| | | | | | |
|---|---|---|---|---|---|
| 1,824,217 | A * | 9/1931 | Kreiner | E05F 3/20 | 16/54 |
| 3,074,101 | A * | 1/1963 | Hideyoshi | E05F 3/20 | 16/303 |
| 5,031,270 | A * | 7/1991 | Lee | E05F 3/16 | 16/341 |
| 5,152,029 | A * | 10/1992 | Pai | E05D 5/10 | 16/54 |
| 5,195,210 | A * | 3/1993 | Lee | E05F 3/20 | 16/354 |
| 5,219,372 | A * | 6/1993 | Lee | E05F 3/08 | 16/54 |
| 5,572,768 | A * | 11/1996 | Daul | E05F 1/1215 | 16/337 |
| 5,855,040 | A * | 1/1999 | Lin | E05D 5/10 | 16/50 |
| 6,658,694 | B2 * | 12/2003 | Wang | E05F 1/1223 | 16/284 |

(Continued)

*Primary Examiner* — William Miller
(74) *Attorney, Agent, or Firm* — Trop Pruner & Hu, P.C.

(57) ABSTRACT

A hinge assemblage includes a leaf mechanism, an actuating unit and a damping unit. The leaf mechanism includes a first leaf, and a second leaf pivotable relative to the first leaf such that the hinge assemblage is convertible between first and second states. The actuating unit is mounted to the leaf mechanism, and generates an actuating force during the conversion of the hinge assemblage. The damping unit is mounted to the leaf mechanism for generating a damping force. The damping force generated by the damping unit during the conversion of the hinge assemblage toward the first state is different from the damping force generated by the damping unit during the conversion of the hinge assemblage toward the second state.

24 Claims, 34 Drawing Sheets

(56) References Cited

U.S. PATENT DOCUMENTS 7,966,693 B2 * 6/2011 Choi ..... E05F 3/20
16/284
8,683,654 B2 * 4/2014 Chen ..... E05D 11/087
16/298

* cited by examiner

HINGE ASSEMBLAGE

FIELD

The disclosure relates to a hinge assemblage, and more particularly to an adjustable hinge assemblage.

BACKGROUND

Referring to FIGS. 1 and 2, a conventional hinge disclosed in Taiwanese Patent No. I441987 (Chinese Patent Certificate No. I696604) includes a leaf mechanism 11 and a torque-providing module 12. The leaf mechanism 11 includes a first leaf 111 fixed to a first object (not shown), a second leaf 112 fixed to a second object (not shown), a plurality of first barrels 113 fixed to the first leaf 111, and a plurality of second barrels 114 fixed to the second leaf 112. The first barrels 113 and the second barrels 114 are disposed in an alternating arrangement and pivoted to each other. The torque-providing module 12 is inserted into the first and second barrels 113, 114, and includes a core axle 121 that is co-rotatable with the first barrels 113, an inner tube 122 that is co-rotatable with the second barrels 114, and a torsion spring 123 that has two opposite end portions respectively fixed to the core axle 121 and the inner tube 122 for providing restoring torque.

When external forces are applied on the conventional hinge to pivot the first and second leaves 111, 112 relative to each other from an initial state, the core axle 121 and the inner tube 122 are driven to deform the torsion spring 123 so as to generate a restoring torque. When the external forces are removed, the restoring torque generated by the torsion spring 123 pivots the first and second leaves 111, 112 relative to each other toward the initial state.

However, a high-speed relative pivotal movement between first and second leaves 111, 112 toward the initial state may cause a severe collision between the first and second objects. On the contrary, if a damping device is employed in the conventional hinge to damp the relative pivotal movement between first and second leaves 111, 112 toward the initial state so as to prevent the severe collision between the first and second objects, the relative pivotal movement of first and second leaves 111, 112 away from the initial state may be considerably retarded.

SUMMARY

Therefore, an object of the disclosure is to provide a hinge assemblage that can alleviate at least one of the drawbacks of the prior art.

According to the disclosure, the hinge assemblage is for pivotally interconnecting first and second objects, and includes a leaf mechanism, an actuating unit and a damping unit. The leaf mechanism includes a first leaf unit. The first leaf unit includes a first leaf fixed to the first object, a second leaf fixed to the second object and pivotable relative to the first leaf, a plurality of first barrels fixed to the first leaf, and a plurality of second barrels fixed to the second leaf. The first barrels and the second barrels are disposed along an axis in an alternating arrangement. The hinge assemblage is operable to convert between an initial state and an open state. An angle formed between the first and second leaves when the hinge assemblage is in the initial state is different from that angle formed between the first and second leaves when the hinge assemblage is in the open state. The actuating unit is mounted to the first and second barrels of the first leaf unit, and includes a tubular member, a connecting axle and an actuating module. The tubular member is co-rotatable with the first leaf and the first barrels of the first leaf unit. The connecting axle extends into the tubular member and is co-rotatable with the second leaf and the second barrels of the first leaf unit. The actuating module is disposed in the tubular member and generates an actuating force during the conversion of the hinge assemblage between the initial and open states. The damping unit is mounted to the first and second barrels of the first leaf unit, and includes an oil tube, a first acting member, a follower member and a hydraulic module. The oil tube is co-rotatable with the first leaf and the first barrels of the first leaf unit. The first acting member is disposed fixedly in the oil tube and has an inclined cam surface. The follower member is movable relative to the oil tube along the axis, and has a main body that is disposed in the oil tube and that has a first abutment surface facing toward the cam surface of the first acting member, and a rod section that extends through the first acting member and out of the oil tube to engage the connecting axle of the actuating unit such that the follower member is co-rotatable with the connecting axle of the actuating unit. The follower member is guided by the first acting member to move relative to the oil tube in a first direction during the conversion of the hinge assemblage from the initial state to the open state, and in a second direction opposite to the first direction during the conversion of the hinge assemblage from the open state to the initial state. The hydraulic module is disposed in the oil tube for generating a damping force upon the movement of the follower member relative to the oil tube. The hydraulic module is configured such that the damping force generated by the hydraulic module during the conversion of the hinge assemblage from the initial state to the open state is different from the damping force generated by the hydraulic module during the conversion of the hinge assemblage from the open state to the initial state.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
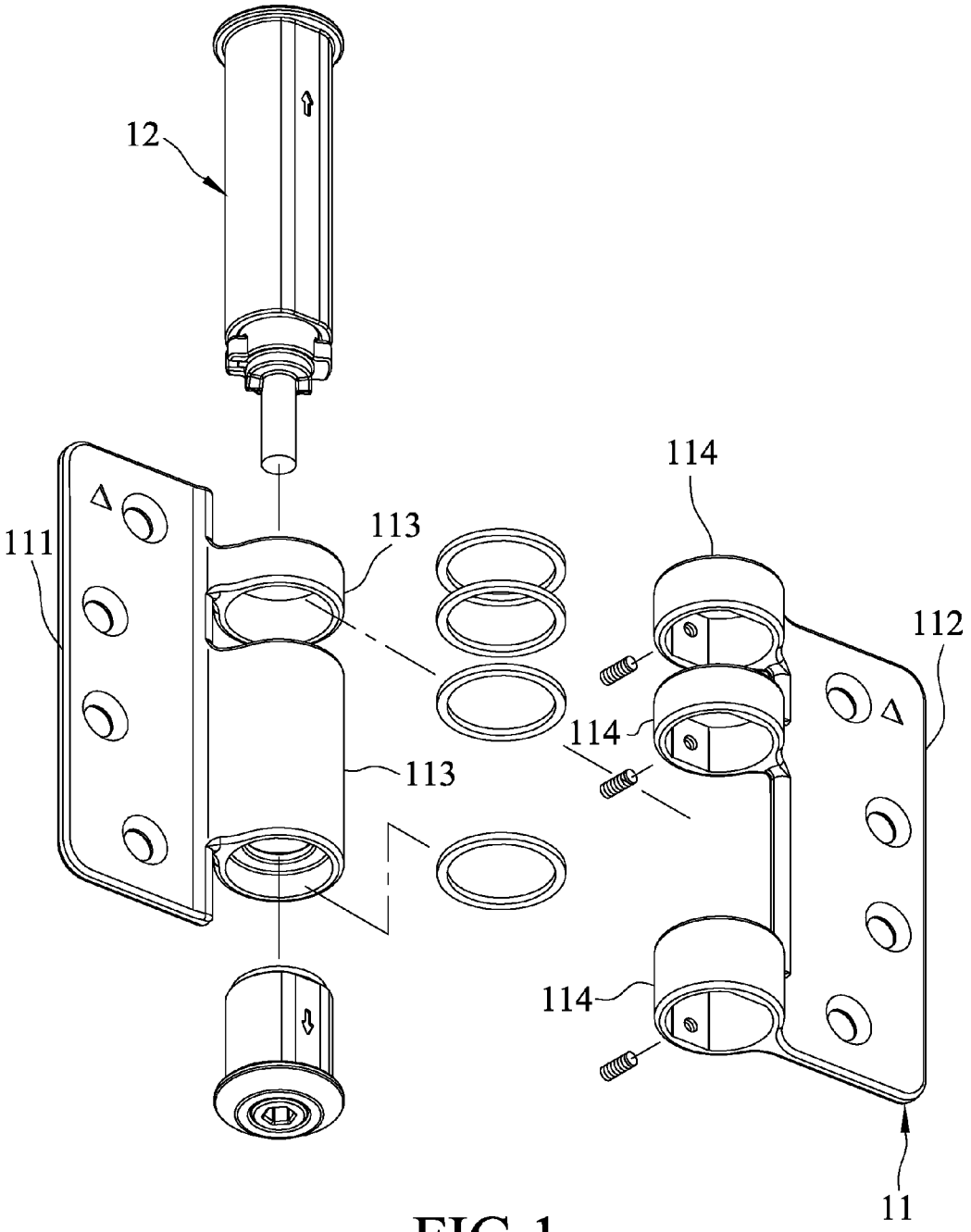
FIG.1 PRIOR ART
FIG. 1 is a partly exploded perspective view illustrating the conventional hinge in Taiwanese Patent No. I441987.
Figure 2:
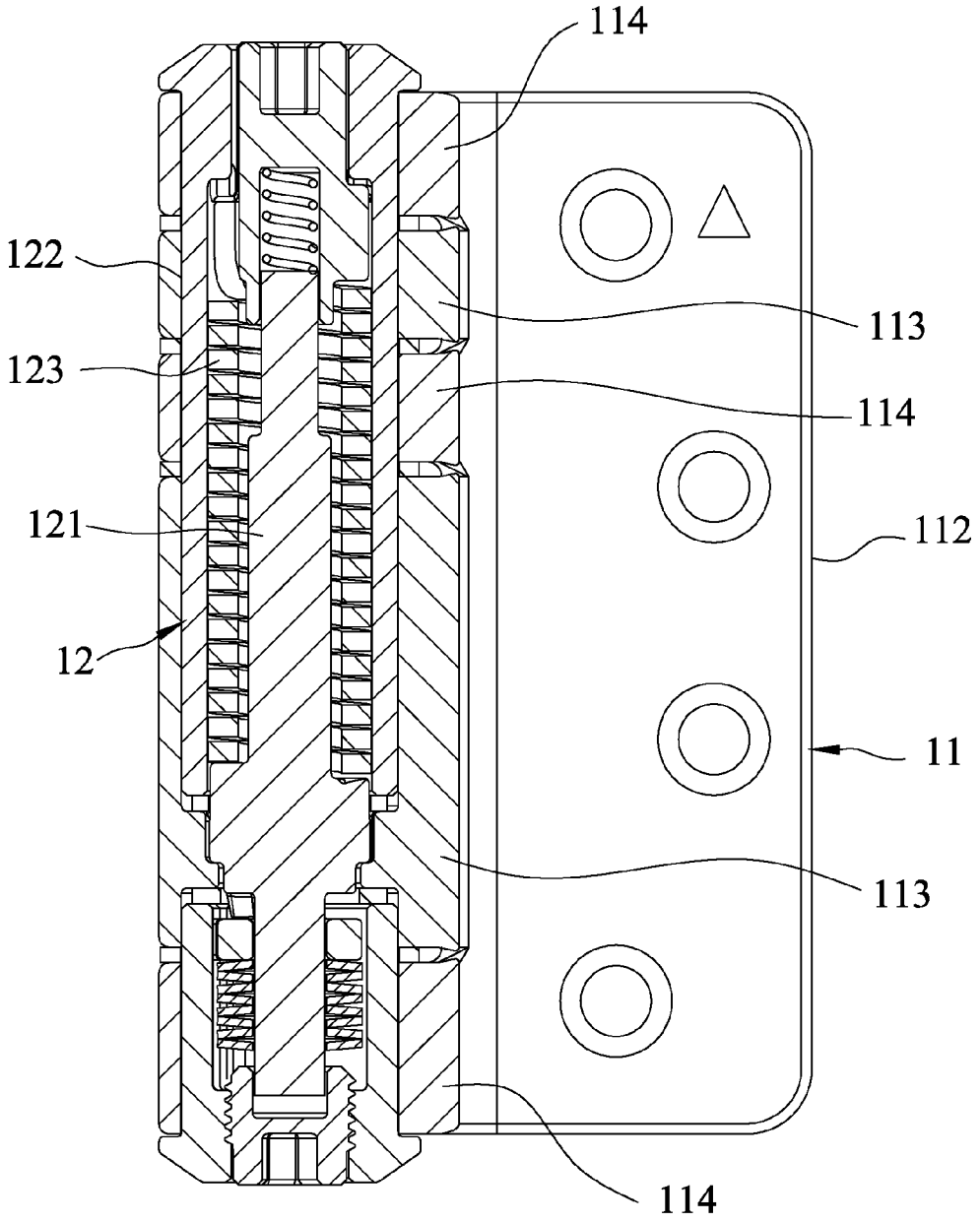
FIG.2 PRIOR ART
FIG. 2 is a sectional view illustrating the conventional hinge in Taiwanese Patent No. I441987.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
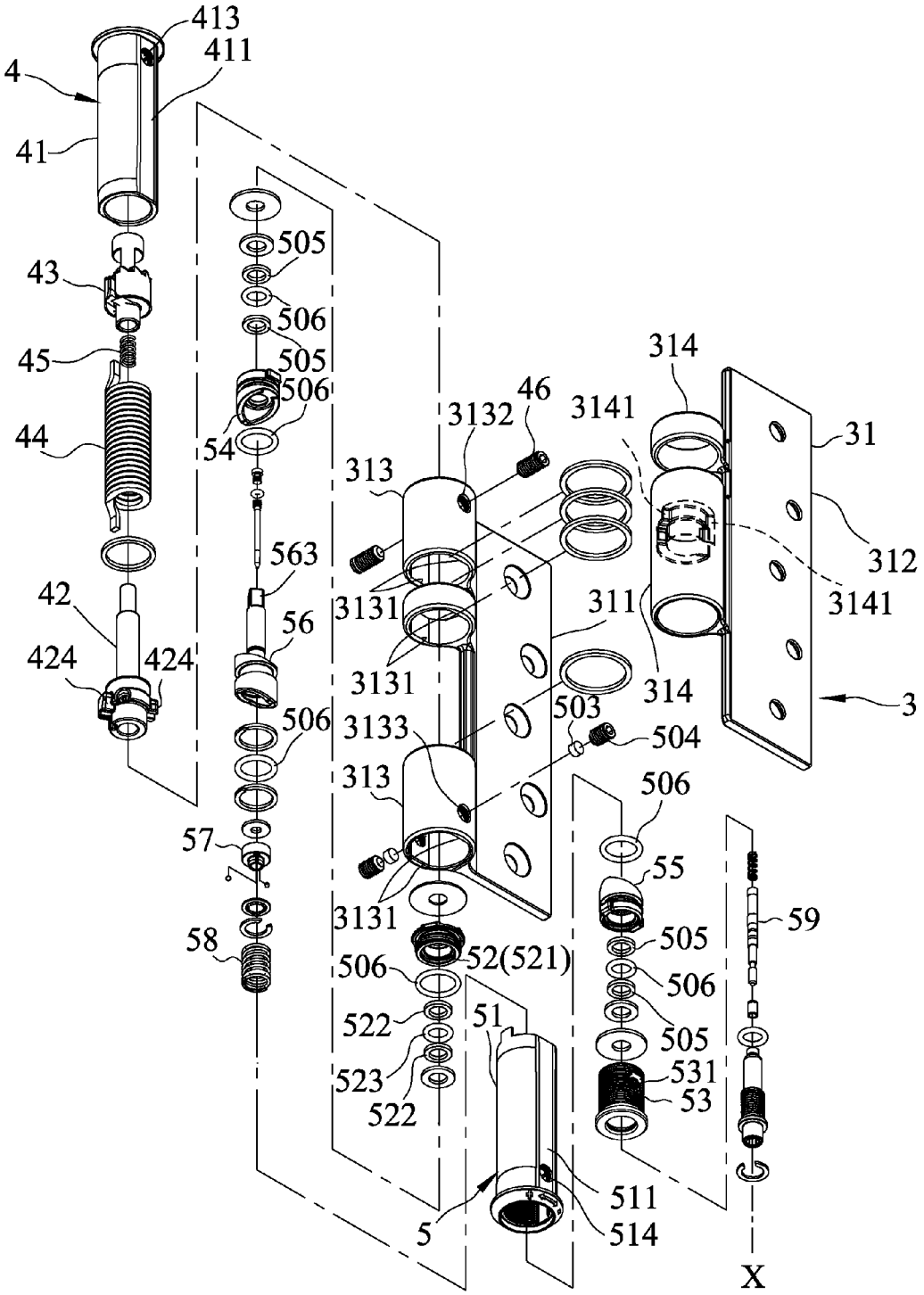
FIG. 3 is an exploded perspective view illustrating a first embodiment of the hinge assemblage according to the disclosure.

Referring to FIG. 3, the first embodiment of the hinge assemblage according to the disclosure is for pivotally interconnecting first and second objects 21, 22 (see FIGS. 15 and 18), and includes a leaf mechanism 3, a first actuating unit 4 and a damping unit 5. The first object 21 may be configured as one of a door and a doorframe, and the second object 22 may be configured as the other one of the door and the doorframe.

The leaf mechanism 3 includes a first leaf unit 31. The first leaf unit 31 includes a first leaf 311 fixed to the first object 21, a second leaf 312 fixed to the second object 22 and pivotable relative to said first leaf 311, a plurality of first barrels 313 fixed to the first leaf 311, and a plurality of second barrels 314 fixed to the second leaf 312. The first barrels 313 and the second barrels 314 are disposed along an axis (X) in an alternating arrangement. An inner surrounding surface of each of the first barrels 313 has two diametrically spaced-apart limiting surface portions 3131. One of the second barrels 314 has two diametrically spaced-apart limiting grooves 3141 that are formed in an inner surrounding surface thereof and that extend in the direction of the axis (X). Each of two opposite endmost ones of the first barrels 313 along the axis (X) is formed with two diametrically opposite first threaded through holes 3132, 3133 (see FIG. 11).

Figure 4:
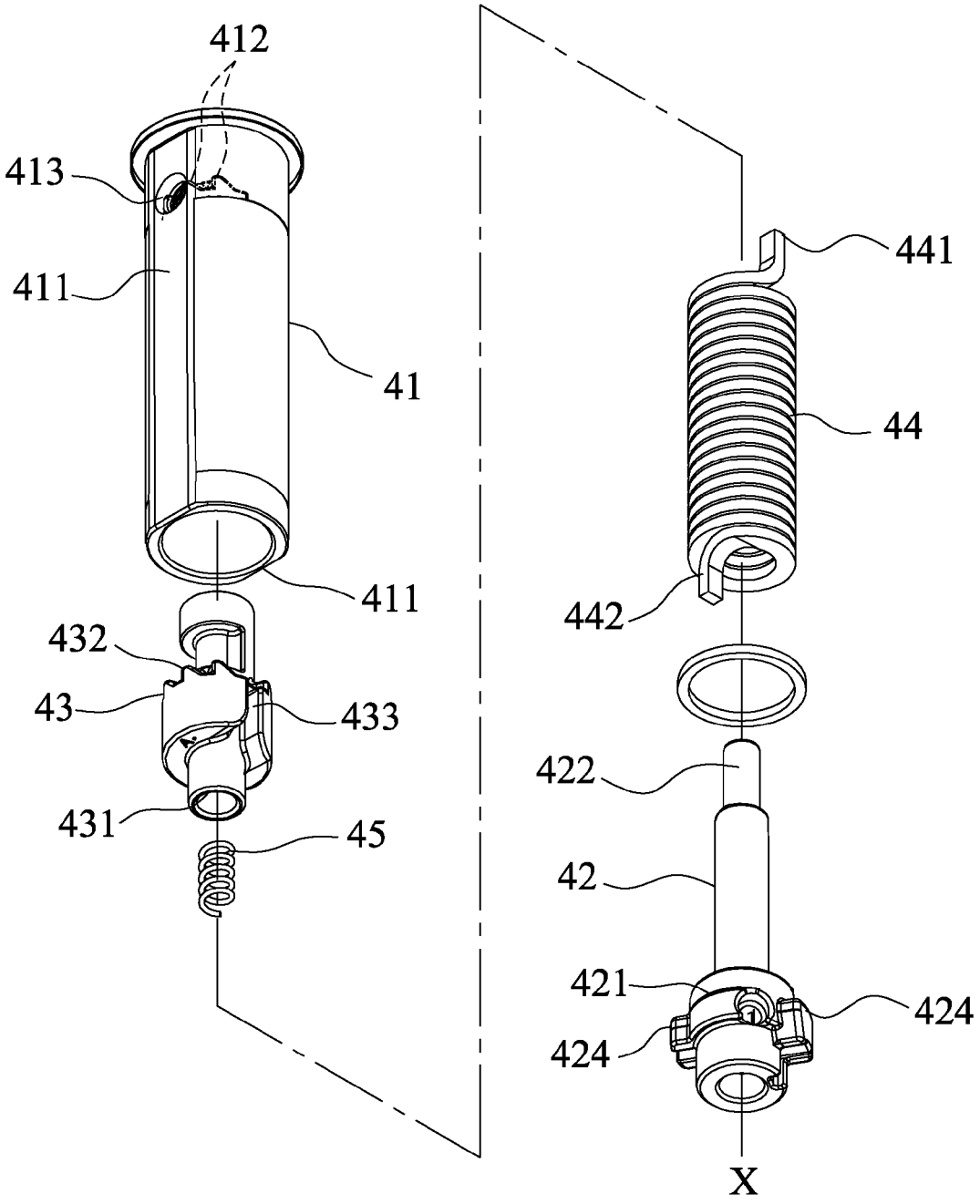
FIG. 4 is an exploded perspective view illustrating a first actuating unit of the first embodiment.
Figure 5:
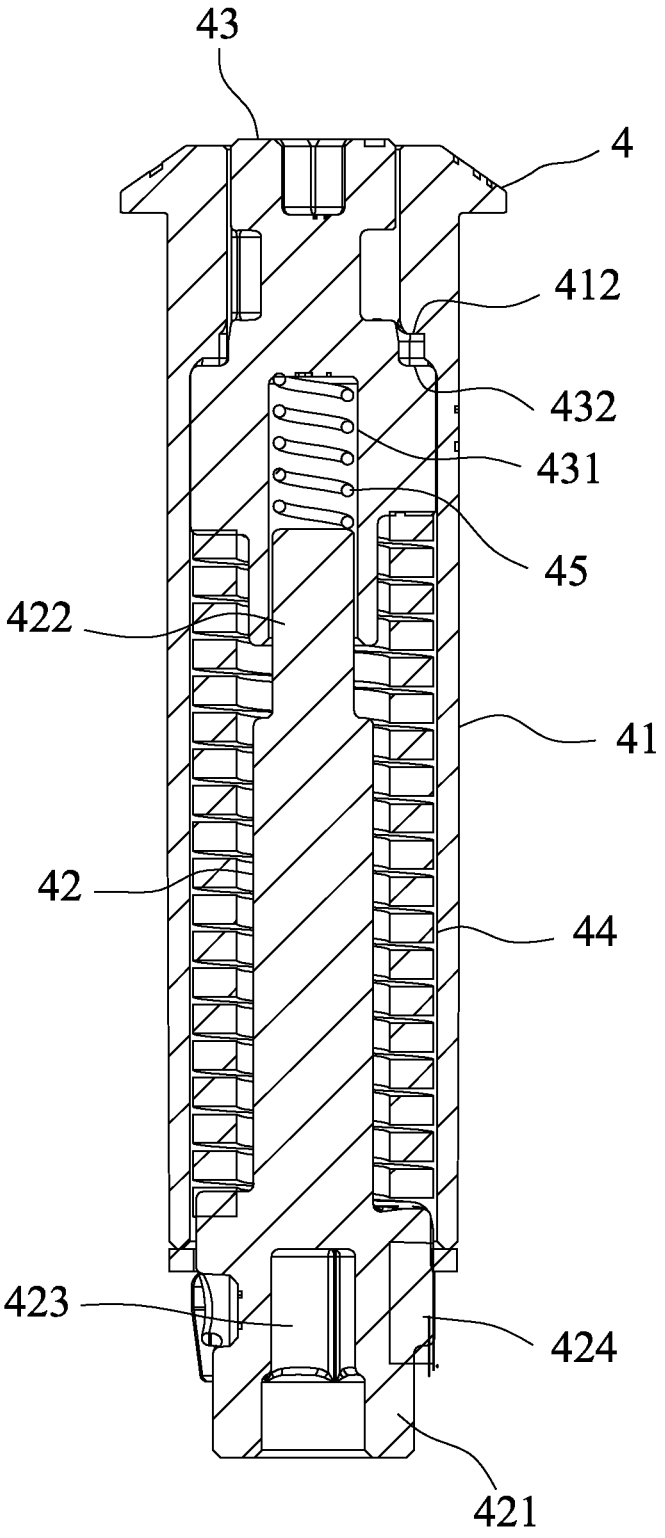
FIG. 5 is sectional view illustrating the first actuating unit of the first embodiment.

Referring further to FIGS. 4 and 5, the first actuating unit 4 includes a first tubular member 41, a connecting axle 42, a first torque-controlling member 43, a first torsion spring 44, a first resilient member 45 and two bolts 46. The first tubular member 41 is inserted into the corresponding first and second barrels 313, 314, and is co-rotatable with the first leaf 311 and the first barrels 313. The connecting axle 42 is disposed adjacent to one end of the first tubular member 41. The first torque-controlling member 43 is disposed adjacent to the other end of the first tubular member distal from the connecting axle 42, and cooperates with the first torsion spring 44 to serve as an actuating module.

An outer surface of the first tubular member 41 has two diametrically opposite limiting surface portions 411 that respectively abut against the limiting surface portions 3131 of each of the corresponding first barrels 313, such that the first tubular member 41 is co-rotatable with the first barrels 313 and the first leaf 311. The first tubular member 41 further has a plurality of first engaging teeth 412 that are formed on an inner surface thereof and that surround the axis (X), and two second threaded through holes 413 (see FIG. 11) that are respectively registered with the first threaded through holes 3132 of the corresponding first barrel 313.

The connecting axle 42 has opposite first and second end portions 421, 422 that are disposed along the axis (X), a polygonal hole 423 (see FIG. 5) that is formed in the first end portion 421 and that extends along the axis (X), and two diametrically spaced-apart protrusions 424 that are formed on an outer surrounding surface of the first end portion 421. The second end portion 422 of the connecting axle 42 extends into the first tubular member 41. The protrusions 424 of the connecting axle 42 respectively engage the limiting grooves 3141 of the one of the second barrels 314 such that the connecting axle 42 is co-rotatable with the second barrels 314 and the second leaf 312.

The first torque-controlling member 43 has an insertion hole 431 that extends along the axis (X) and that permits the second end portion 422 of the connecting axle 42 to be inserted thereinto, a plurality of second engaging teeth 432 that are formed on an outer surface thereof and that are removably engaged with the first engaging teeth 412 of the first tubular member 41, and a coupling groove 433 that is formed in the outer surface thereof and that extends along the axis (X). The first and second engaging teeth 412, 432 are configured such that the first tubular member 41 and the first torque-controlling member 43 are co-rotatable when the first tubular member 41 is rotated in a first rotational direction or when the first torque-controlling member 43 is rotated in a second rotational direction opposite to the first rotational direction, and that the first torque-controlling member 43 is rotatable relative to the first tubular member 41 when the first torque-controlling member 43 is rotated in the first rotational direction.

The first torsion spring 44 is retained in the first tubular member 41, surrounds the connecting axle 42, and has two opposite end sections 441, 442 that extend along the axis (X). The upper end section 441 is co-movably inserted into the coupling groove 433 of the first torque-controlling member 43. The lower end section 442 co-movably abuts against one of the protrusions 424 of the connecting axle 42.

The first resilient member 45 is disposed in the insertion hole 431 of the first torque-controlling member 43, and has two opposite ends respectively abutting against the first torque-controlling member 43 and the second end portion 422 of the connecting axle 42 for resiliently biasing the first torque-controlling member 43 and the connecting axle 42 away from each other.

Each of the bolts 46 is configured as a set screw, and engages threadably a respective one of the first threaded through holes 3132 of the corresponding first barrel 313 and a corresponding one of the second threaded through holes 413 of the first tubular member 41 to abut against the first torque-controlling member 43 for preventing relative movement between the first tubular member 41 and the first torque-controlling member 43.

Referring to FIG. 3, and 6 to 9, the damping unit 5 includes an oil tube 51, a cap assembly 52, a sleeve member 53, a first acting member 54, a second acting member 55, a follower member 56, a one-way valve assembly 57, a second resilient member 58, a throttle assembly 59, two pad members 503, two bolts 504, a plurality of back-up rings 505 and a plurality of sealing rings 506. The first and second acting members 54, 55 are disposed fixedly in the oil tube 51. The follower member 56 is partially disposed in the oil tube 51 and between the first and second acting members 54, 55, and is movable relative to the oil tube 51. The follower member 56 cooperates with the first acting member 54 to define a first oil chamber 501 therebetween, and cooperates with the second acting member 55 to define a second oil chamber 501 therebetween. The first and second oil chambers 501, 502 are filled with oil. The one-way valve assembly 57 and the throttle assembly 59 cooperatively serve as a hydraulic module.

An outer surface of the oil tube 51 has two diametrically opposite limiting surface portions 511 that respectively abut against the limiting surface portions 3131 of each of the corresponding first barrels 313, such that the oil tube 51 is co-rotatable with the first barrels 313 and the first leaf 311. The oil tube 51 further has two diametrically opposite first positioning grooves 512 that are formed in an inner surface thereof and that are proximate to one of two opposite longitudinal ends thereof, two diametrically opposite second positioning grooves 513 that are formed in the inner surface thereof and that are proximate to the other one of the two opposite longitudinal ends thereof, and two third threaded through holes 514 (see FIG. 11) that are respectively registered with the first threaded through holes 3133 of the corresponding first barrel 313.

The first acting member 54 has an inclined cam surface 541 that faces toward the second acting member 55, and two positioning protrusions 542 that are formed on an outer surface thereof and that respectively engage the first positioning grooves 512 of the oil tube 51 so that the first acting member 54 is fixedly positioned in the oil tube 51.

The second acting member 55 has an inclined cam surface 551 that faces toward the first acting member 54, and two positioning protrusions 552 that are formed on an outer surface thereof and that respectively engage the second positioning grooves 513 of the oil tube 51 so that the second acting member 55 is fixedly positioned in the oil tube 51.

The follower member 56 has a main body 560 that has opposite first and second abutment surfaces 561, 562 respectively facing toward the cam surfaces 541, 551 of the first and second acting members 54, 55, a polygonal rod section 563 that extends away from the second acting member 54, through the first acting member 54 and out of the oil tube 51, a communicating passage 564 that extends along the axis (X) and through the main body 560 and the polygonal rod section 563, and a communicating hole 565 that is formed in the polygonal rod section 563 and that fluidly communicates with the communicating passage 564 and the first oil chamber 501. The polygonal rod section 563 is inserted into the polygonal hole 423 of the connecting axle 42 of the first actuating unit 4 in such a manner that the follower member 56 is co-rotatable with the connecting axle 42 about the axis (X) and is movable relative to the connecting axle 42 along the axis (X). The communicating passage 564 has a first end opening 5641 that is proximate to the second acting member 55, and a second end opening 5642 that is opposite to the first end opening 5641 and that is proximate to the connecting axle 42. The follower member 56 further has an inner threaded portion 5643 that is proximate to the second end opening 5642.

The cap assembly 52 and the sleeve member 53 are respectively threaded to the two opposite longitudinal ends of the oil tube 51. The sleeve member 53 has two through holes 531 that are respectively registered with the third threaded through holes 514 of the oil tube 51. The cap assembly 52 includes a cap body 521 that is threaded to the oil tube 51 and that permits the polygonal rod section 563 of the follower member 56 to extend therethrough, a plurality of back-up rings 522 that are sleeved between the cap body 521 and the polygonal rod section 563 of the follower member 56, and a sealing ring 523 that is sleeved on the follower member 56 between the cap body 521 and the polygonal rod section 563 of the follower member 56 and that is forcibly clamped between the back-up rings 522 for air-tightly sealing a gap between the cap body 521 and the polygonal rod section 563 of the follower member 56.

The one-way valve assembly 57 is disposed in the main body 560 of the follower member 56, and includes a valve seat 571, two oil passages 572 each extending in the direction of the axis (X) through the valve seat 571 and fluidly communicating with the communicating passage 564 and the second oil chamber 502, two valve members 573 each being disposed in a respective one of the oil passages 572 for removably blocking the corresponding oil passage 572, two oil resilient members 574 each being disposed in a respective one of the oil passages 572 for resiliently biasing the corresponding valve member 573 toward the first oil chamber 501 so as to block the corresponding oil passage 572, and an extension hole 575 extending along the axis (X) through the valve seat 571. A middle portion of the extension hole 575 has an inner diameter smaller than that of each of two opposite longitudinal end portions of the extension hole 575.

The second resilient member 58 is disposed in the oil tube 51, and has two opposite ends respectively abutting against the second acting member 55 and the follower member 56.

The throttle assembly 59 extends along the axis (X) through the sleeve member 53, the second acting member 55, the follower member 56 and the one-way valve assembly 57, and includes a mounting bolt 591, a needle 592, a pin resilient member 593, a pin 594, a sleeve piece 595, a sealing ring 596 and a securing member 597.

The mounting bolt 591 extends along the axis (X) through the second acting member 55 and the sleeve member 53, engages threadably the sleeve member 53, and has a hexagonal hole 5911 formed in an end thereof and exposed out of the sleeve member 53.

The needle 592 extends along the axis (X) through the extension hole 575 of the one-way valve assembly 57, and has a first end portion 5921 that is rotatably mounted to the mounting bolt 591, a second end portion 5923 that is opposite to the first end portion 5921 and that extends into the polygonal rod section 563 of the follower member 56, a channel 5922 that is formed in the second end portion 5923 and that is defined by a channel-defining surface, an outer shoulder surface 5924 that is formed on the first end portion 5921, two annular clinging surfaces 5927 that are formed on an outer surrounding surface of the second end portion 5923, that are spaced apart from each other along the axis (X), and that fluid-tightly cling to an inner surface of the polygonal rod section 563 of the follower member 56, a first communicating hole 5925 that is formed in the second end portion 5923 and that fluidly communicates with the channel 5922 and a space defined between the annular clinging surfaces 5927, and two second communicating holes 5926 that are formed in the second end portion 5923 and that fluidly communicates with the channel 5922 and a space defined at one side of the annular clinging surfaces 5927 proximate to the first end portion 5921.

The pin 594 extends along the axis (X), is inserted into the polygonal rod section 563 of the follower member 56 and the channel 5922 of the needle 592, and cooperates with the channel-defining surface of the needle 5922 to define an oil space 5940 therebetween. The pin 594 has a conical section (I) that tapers toward the second acting member 55 and that has a tapered annular surface 5941, a head section 5942 that is distal from the second acting member 55 and that is threadedly secured to the polygonal rod section 563, and a hexagonal hole 5943 (see FIG. 9) that is formed in the head section 5942.

The sleeve piece 595 is sleeved on the needle 592, abuts against the mounting bolt 591 and the outer shoulder surface 5924 of the needle 592, and has a rounded head portion 5951 that is formed at one end thereof proximate to the outer shoulder surface 5924 of the needle 592. The sleeve piece 595 has an outer diameter greater than that of a segment of the first end portion 5921 distal from the mounting bolt 591.

The securing member 597 is threaded to the inner threaded portion 5643 of the follower member 56, and has a hexagonal hole 5971 (see FIG. 9) that is exposed out of the follower member 56.

The sealing ring 596 is sleeved on the securing member 597, and fluid-tightly seals a gap between the securing member 597 and the polygonal rod section 563 of the follower member 56 so as to fluid-tightly block the second end opening 5642 of the communicating passage 564.

The pad members 503 are respectively disposed in the through holes 531 of the sleeve member 53.

Each of the bolts 504 is configured as a set screw, and engages threadably a respective one of the first threaded through holes 3133 of the corresponding first barrel 313 and a corresponding one of the third threaded through holes 514 of the oil tube 51 to press the corresponding pad member 503 against the mounting bolt 591 for preventing relative movement between the oil tube 51, the sleeve member 53 and the mounting bolt 591.

The sealing rings 506 are respectively and fluid-tightly disposed between the mounting bolt 591 and the sleeve member 53, between the first acting member 54 and the oil tube 51, between the second acting member 55 and the oil tube 51, between the follower member 56 and the oil tube 51, between the first acting member 54 and the polygonal rod section 563 of the follower member 56, and between the second acting member 55 and the mounting bolt 591.

The back-up rings 505 are disposed between the first acting member 54 and the polygonal rod section 563 of the follower member 56 to forcibly press a corresponding sealing ring 506, and between the second acting member 55 and the mounting bolt 591 to forcibly press against another corresponding sealing ring 506.

Figure 7:
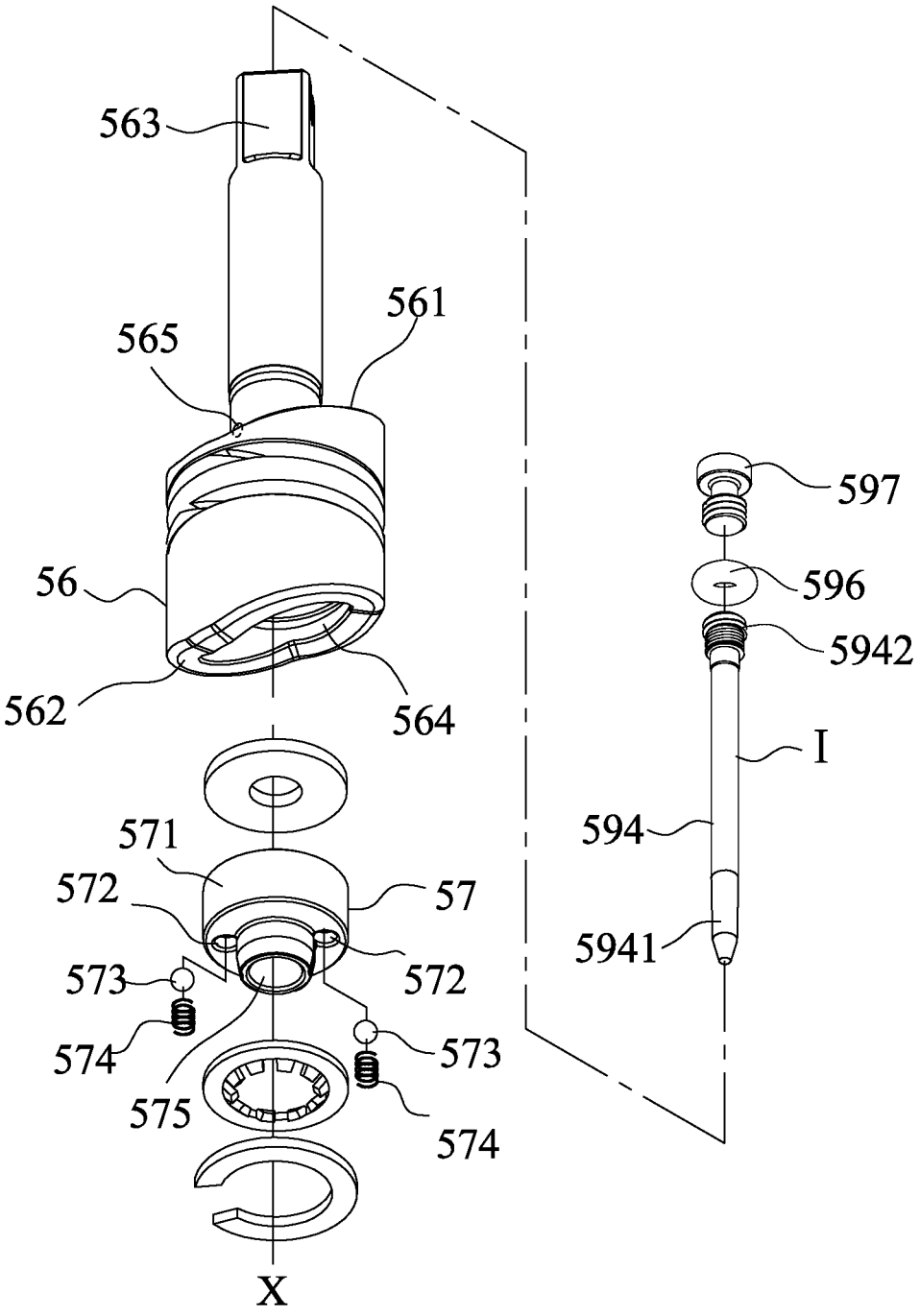
FIG. 7 is an exploded perspective view illustrating a one-way valve assembly and a follower member of the damping unit of the first embodiment.
Figure 8:
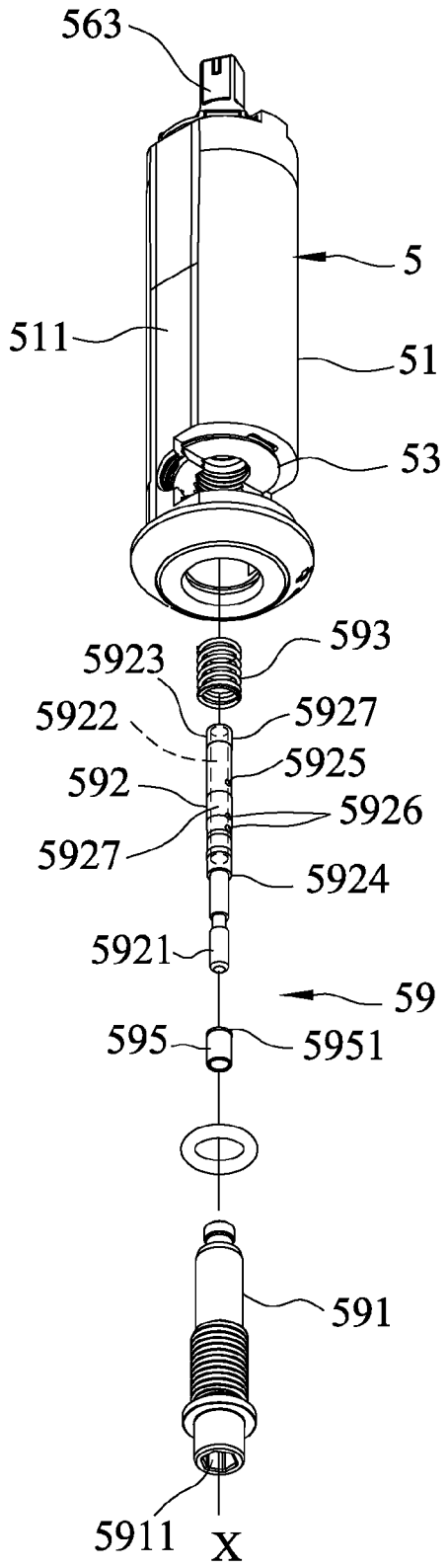
FIG. 8 is a partly exploded perspective view illustrating a throttle assembly of the damping unit of the first embodiment.

Referring further to FIG. 7, to assemble the damping unit 5, the one-way valve assembly 57 is first mounted in the communicating passage 564 of the follower member 56 at a position adjacent to the first end opening 5641, and the pin 594 and the sealing ring 596 are installed into the polygonal rod section 563 via the second end opening 5642. Then, the securing member 597 is threaded to the inner threaded portion 5643 of the follower member 56 to position the pin 594 and the sealing ring 596 within the polygonal rod section 563. After the oil tube 51 is sequentially mounted with the cap assembly 52 and the first acting member 54, the aforesaid assembly of the follower member 56, the one-way valve assembly 57, the securing member 597, the pin 594 and the sealing ring 596 is inserted into the oil tube 51, and then the second resilient member 58, the second acting member 55 and the sleeve member 53 are sequentially mounted into the oil tube 51. Referring further to FIG. 8, afterward, the pin resilient member 593, the needle 592, the sleeve piece 595 and the mounting bolt 591 are sequentially installed into the oil tube 51 in such a manner that the pin 594 is inserted into the channel 5922 of the needle 592 and that the pin resilient member 593 is disposed in the polygonal rod section 563 and has two opposite ends that respective abut against the needle 592 and an inner surface of the rod section 563. The needle 592 is moved relative to the pin 594 when the mounting bolt 591 is turned to move relative to the sleeve member 53.

Figure 9:
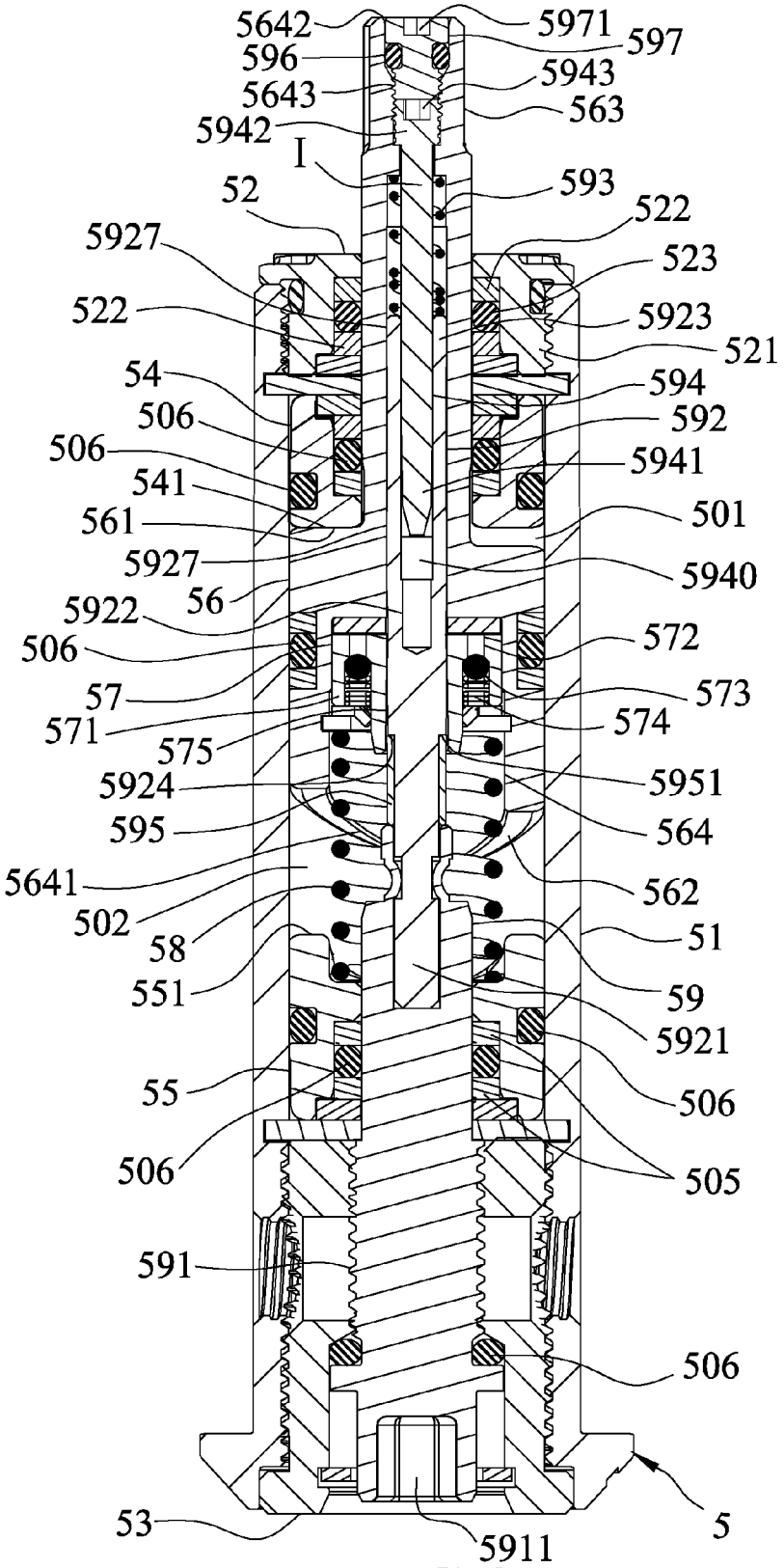
FIG. 9 is a sectional view illustrating the damping unit of the first embodiment.
Figure 10:
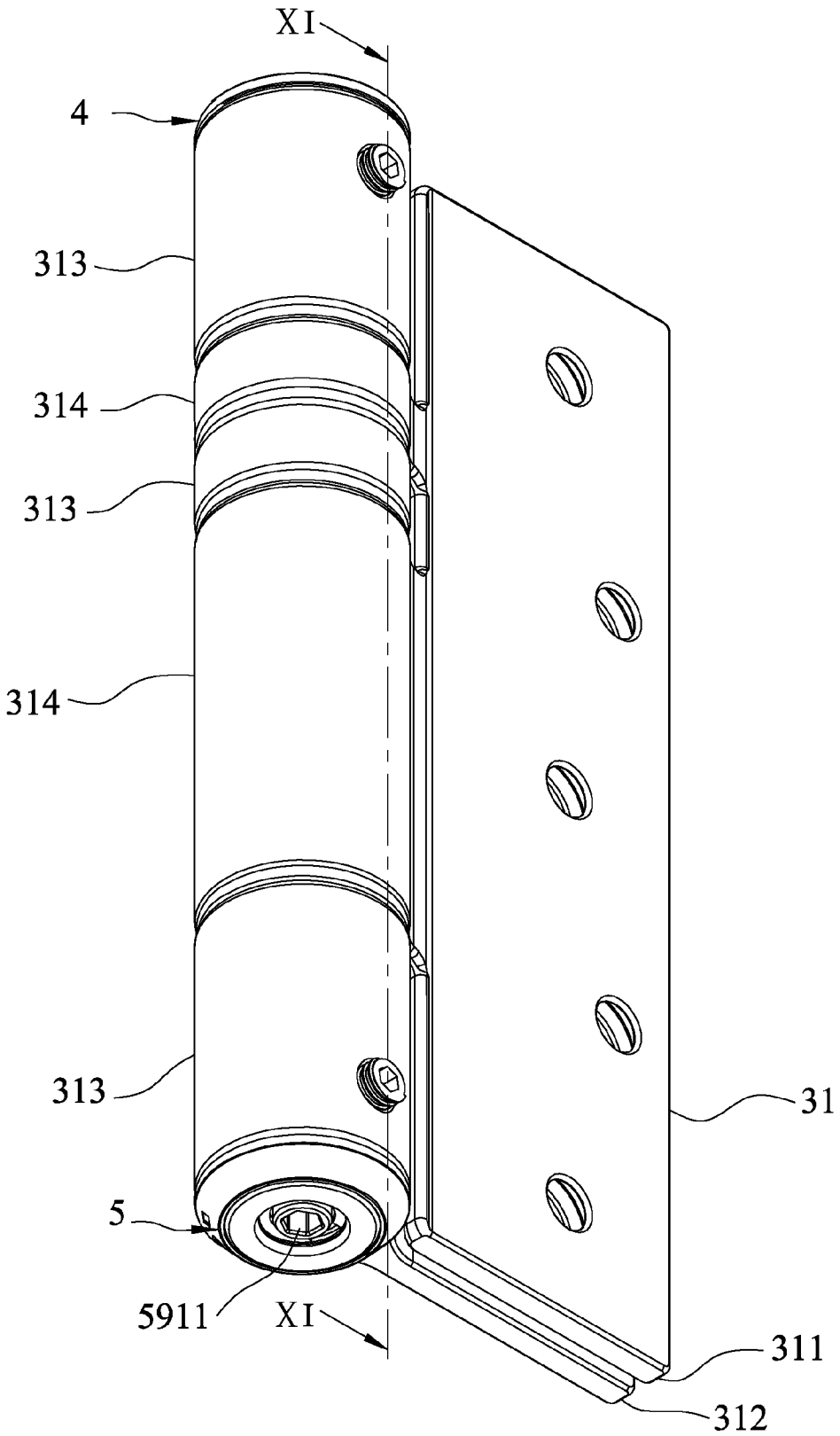
FIG. 10 is a schematic perspective view illustrating the first embodiment in an initial state.
Figure 11:
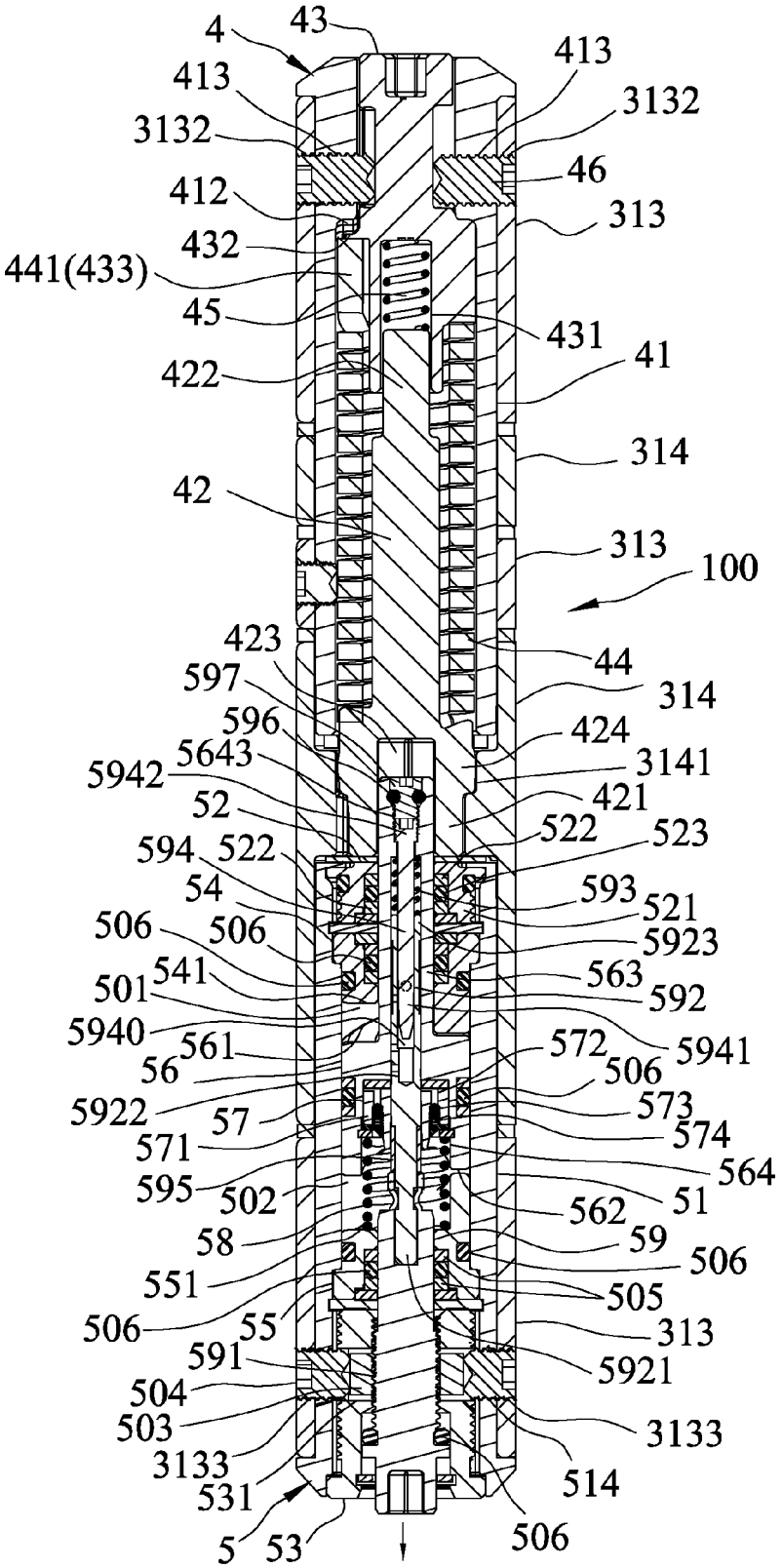
FIG. 11 is a schematic sectional view taken along line XI-XI in FIG. 10 and illustrating the first embodiment in the initial state.
Figure 12:
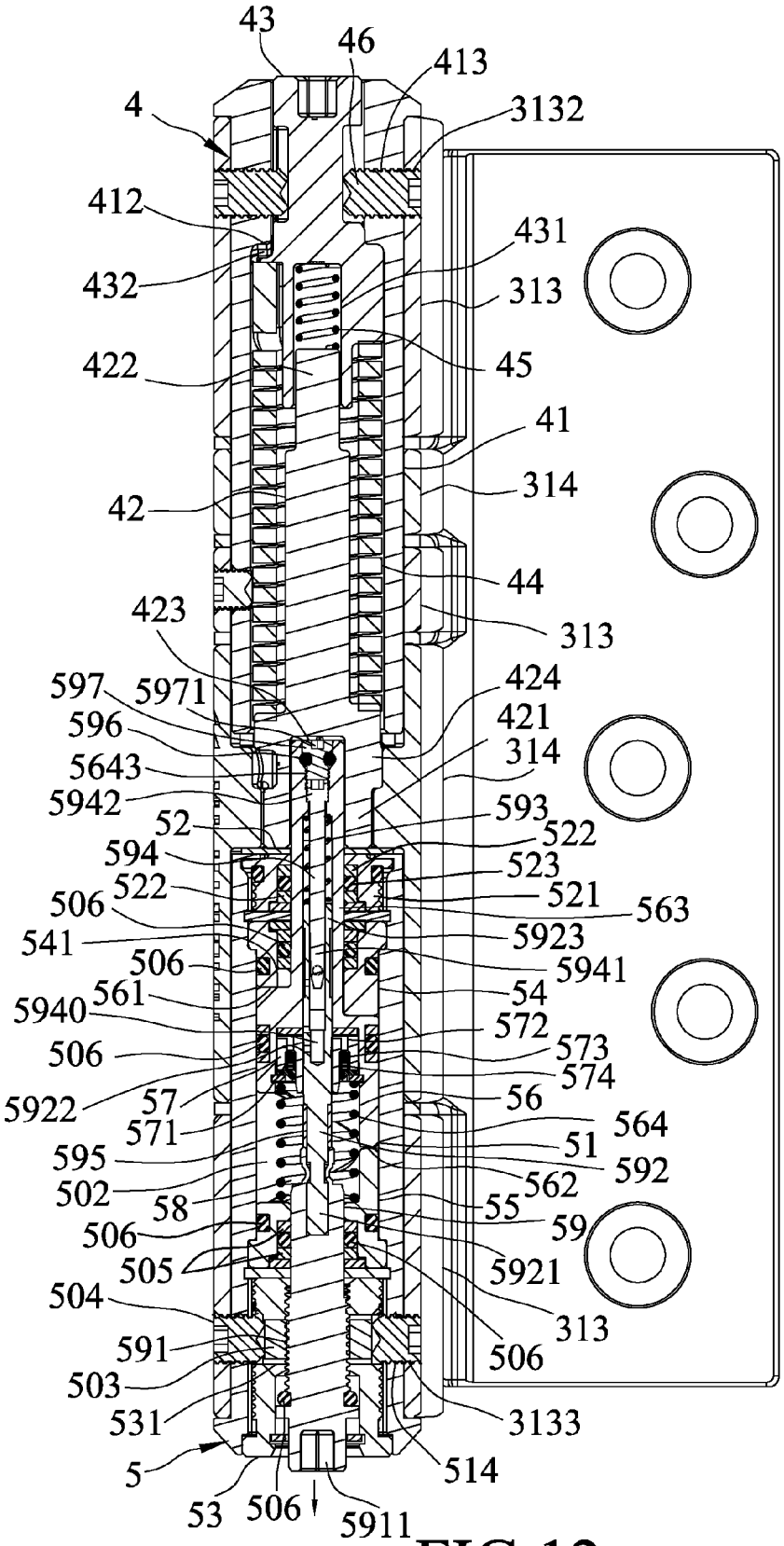
FIG. 12 is another schematic sectional view illustrating the first embodiment in an open state.
Figure 13:
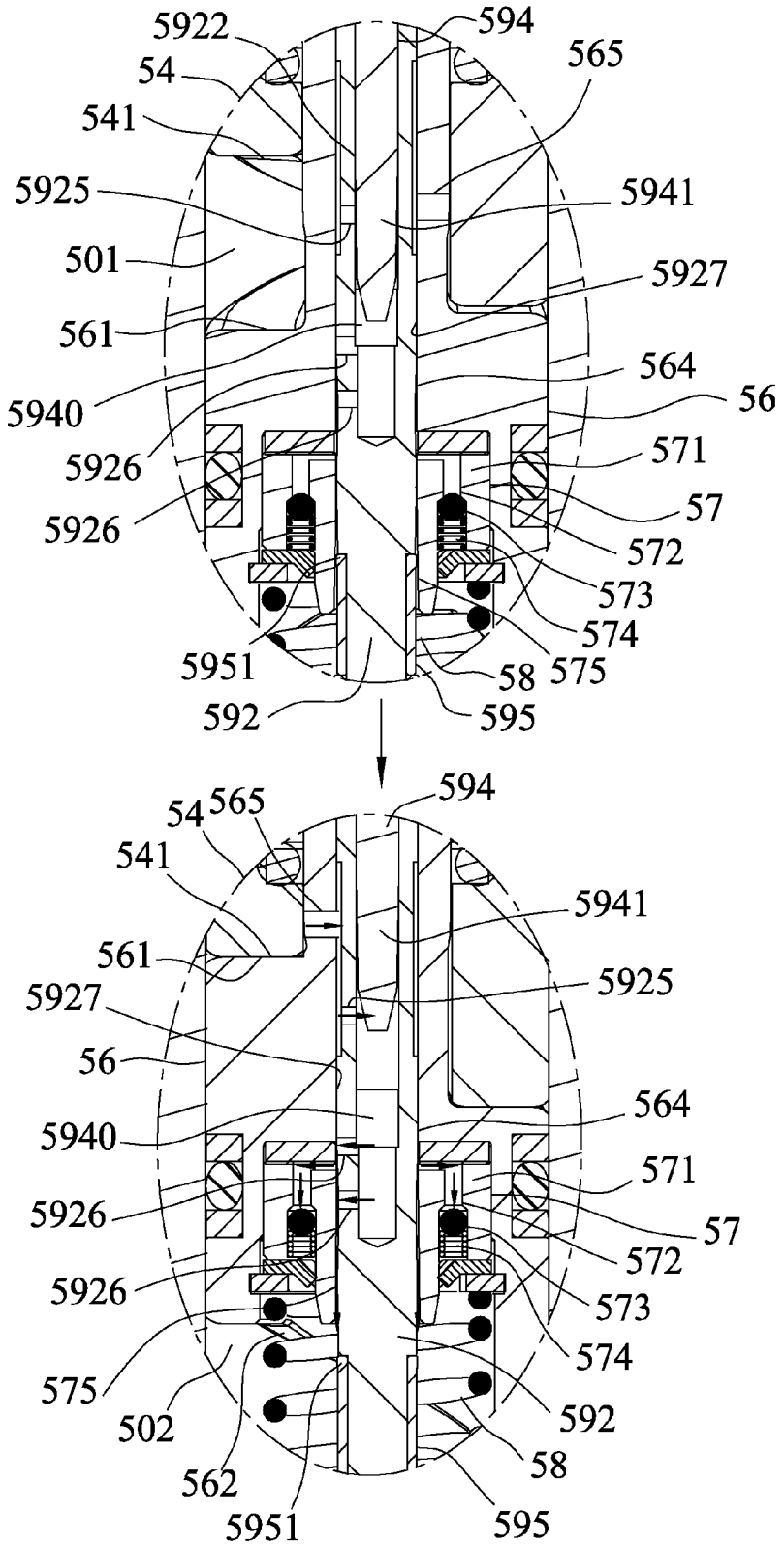
FIG. 13 illustrates the action of the follower member during the conversion of the first embodiment from the initial state to the open state.

Referring to FIGS. 9 to 11, an oil passageway is defined from the first end opening 5641 of the communicating passage 564, via a gap between the sleeve piece 595 and the valve seat 571, a gap between the needle 592 and the valve seat 571, the second communicating holes 5926, the oil space 5940, a gap defined between the pin 594 and an inner surrounding surface of the needle 592 and corresponding in position to the first communicating hole 5925, the first communicating hole 5925, the space defined between the annular clinging surfaces 5927, to the communicating hole 565 of the follower member 56 for fluid communication between the first and second oil chambers 501, 502. Each of the oil passages 572 is in spatial communication with the second oil chamber 502 and the gap between the needle 592 and the valve seat 571. When the mounting bolt 591 is turned by a tool (not shown) to move relative to the sleeve member 53 along the axis (X), the needle 592 is thereby moved relative to the pin 594 so as to adjust the volume of the oil space 5940.

Referring to FIGS. 3 and 10 to 13, when external forces are applied to pivot the first and second leaves 311, 312 relative to each other such that the hinge assemblage is converted from an initial state where an angle formed between the first and second leaves 311, 312 is 0 degree (see FIGS. 10 and 11), to an open state where the angle formed between the first and second leaves 311, 312 is 90 degrees (see FIGS. 12 and 15), the first tubular member 41 of the first actuating unit 4 and the connecting axle 42 are driven to rotate relative to each other, and the oil tube 51 of the damping unit 5 and the follower member 56 are driven to rotate relative to each other.

Referring further to FIG. 4, the first tubular member 41 and the first torque-controlling member 43 are configured to be co-rotatable by virtue of the engagement between the first and second engaging teeth 412, 432 when the hinge assemblage is converted from the initial state to the open state. Since the end sections 441, 442 of the first torsion spring 44 respectively co-movably engage the coupling groove 433 of the first torque-controlling member 43 and one of the protrusions 424 of the connecting axle 42, the first torsion spring 44 is deformed to exert an actuating force, so as to generate a resultant restoring torque in response to the conversion of the hinge assemblage from the initial state to the open state.

Figure 6:
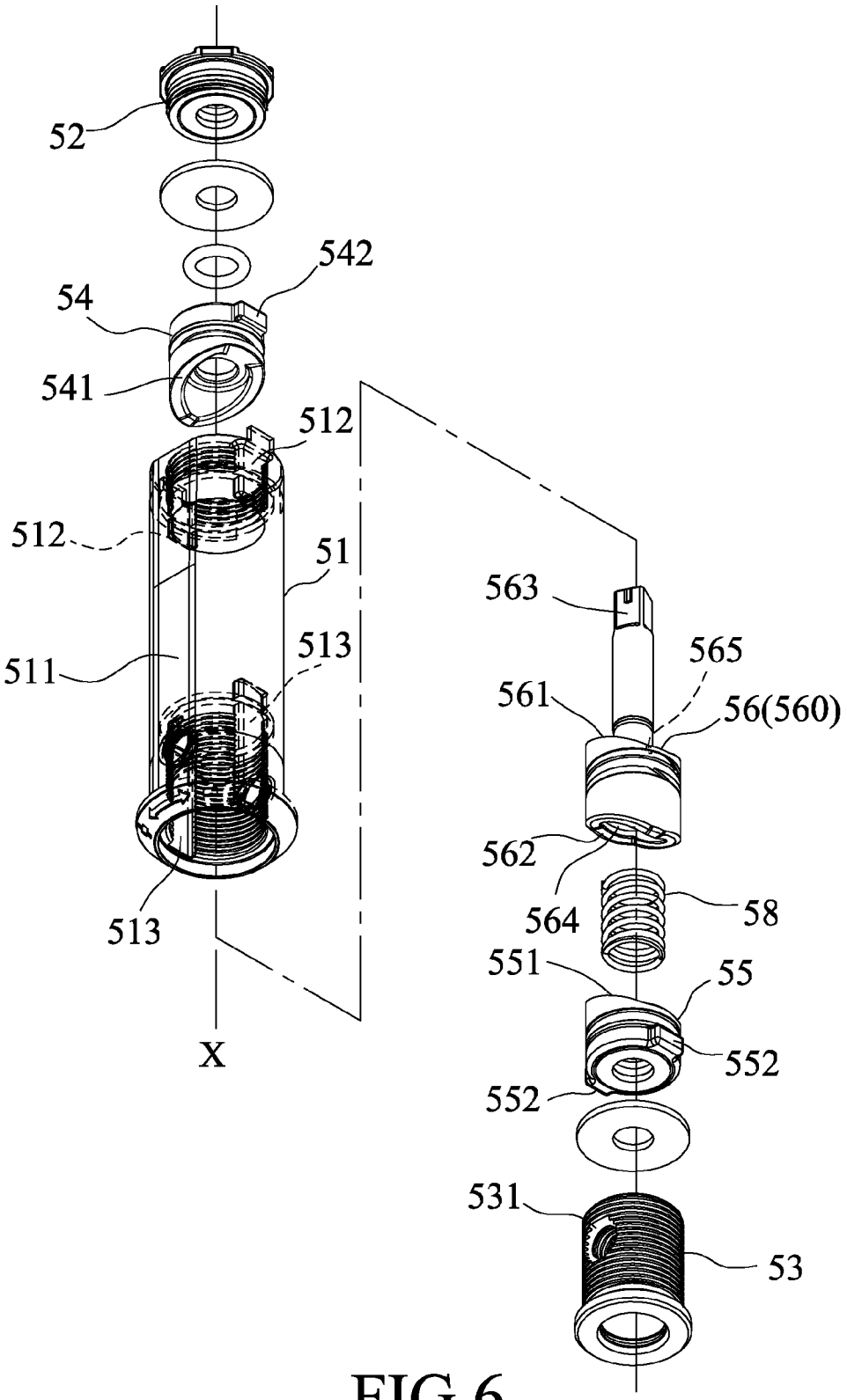
FIG. 6 is an exploded perspective view illustrating a damping unit of the first embodiment.

Referring further to FIG. 6, since the first and second acting members 54, 55 are co-rotatable with the oil tube 51 and since the follower member 56 is co-rotatable with the connecting axle 42, the cam surface 551 of the second acting member 55 is configured to push the second abutment surface 562 of the follower member 56 to move the follower member 56 relative to the oil tube 51 toward the first acting member 54 and away from the second acting member 55 in response to the conversion of the hinge assemblage from the initial state to the open state, so as to compress the first oil chamber 501.

At this time, the oil in the first oil chamber 501 flows through the communicating hole 565 of the follower member 56, the space defined between the annular clinging surfaces 5927, the first communicating hole 5925, the gap between the pin 594 and the inner surrounding surface of the needle 592, the oil space 5940, the second communicating holes 5926 into the gap between the needle 592 and the valve seat 571, and then flows into the second oil chamber 502 via the oil passages 572 of the one-way valve assembly 57 and via the gap between the sleeve piece 595 and the valve seat 571 and the first end opening 5641 of the communicating passage 564. The oil flowing from the gap between the needle 592 and the valve seat 571 through the oil passages 572 of the one-way valve assembly 57 pushes the valve members 573 against the biasing action of the oil resilient members 574 so as to unblock the oil passages 572. During the movement of the follower member 56 away from the second acting member 55, the pin 594 is moved relative to the needle 592 so as to enlarge the gap defined between the pin 594 and the inner surrounding surface of the needle 592 (i.e., the channel-defining surface) and corresponding in position to the first communicating hole 5925.

As such, in the beginning of the conversion of the hinge assemblage from the initial state to the open state, the gap defined between the pin 594 and the inner surrounding surface of the needle 592 and corresponding in position to the first communicating hole 5925 is relatively small, so that a damping force generated by the hydraulic module is relatively large. When the gap defined between the pin 594 and the inner surrounding surface of the needle 592 and corresponding in position to the first communicating hole 5925 is enlarged due to the increase of the angle between the first and second leaves 311, 312, the damping force generated by the hydraulic module becomes relatively small.

Figure 14:
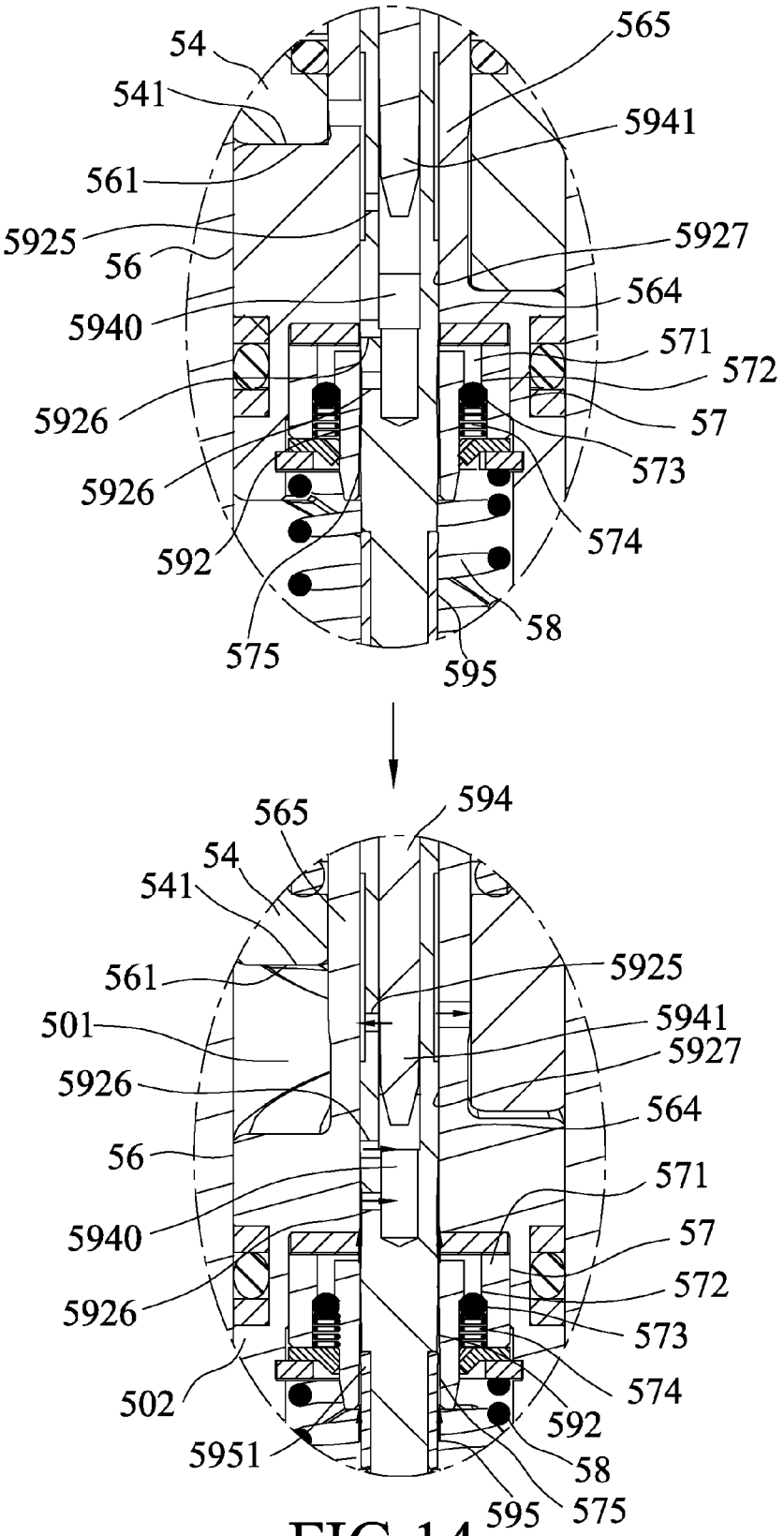
FIG. 14 illustrates the action of the follower member during the conversion of the first embodiment from the open state to the initial state.

Referring further to FIG. 14, when the external forces are removed, the restoring torque generated by the first torsion spring 44 pivots the connecting axle 42 and the first torque-controlling member 43 relative to each other so as to convert the hinge assemblage from the open state to the initial state. The cam surface 541 of the first acting member 54 pushes the first abutment surface 561 of the follower member 56 to move the follower member 56 relative to the oil tube 51 toward the second acting member 55 and away from the first acting member 54 in response to the conversion of the hinge assemblage from the open state to the initial state, so as to compress the second oil chamber 502.

At this time, the oil flowing from the second oil chamber 502 into the oil passages 572 of the one-way valve assembly 57 pushes the valve members 573 against the valve seat 571 so as to block the oil passages 572, so that the oil in the second oil chamber 502 is only permitted to flow into the first oil chamber 501 via the aforesaid oil passageway that is defined from the first end opening 5641 of the communicating passage 564, via the gap between the sleeve piece 595 and the valve seat 571, the gap between the needle 592 and the valve seat 571, the second communicating holes 5926, the oil space 5940, a gap between the pin 594 and the inner surrounding surface of the needle 592, the first communicating hole 5925, the space defined between the annular clinging surfaces 5927, to the communicating hole 565 of the follower member 56. As a result, the damping force generated by the hydraulic module during the conversion of the hinge assemblage from the open state to the initial state is greater than the damping force generated by the hydraulic module during the conversion of the hinge assemblage from the initial state to the open state.

During the conversion of the hinge assemblage from the open state to the initial state, when the angle between the first and second leaves 311, 312 is nearly 0 degree, the valve seat 571 is moved toward the sleeve piece 595 so as to narrow the gap between the sleeve piece 595 and the valve seat 571, and the pin 594 is moved relative to the needle 592 so as to narrow the gap defined between the pin 594 and the inner surrounding surface of the needle 592 and corresponding in position to the first communicating hole 5925, so that the damping force generated by the hydraulic module becomes even greater.

Figure 15:
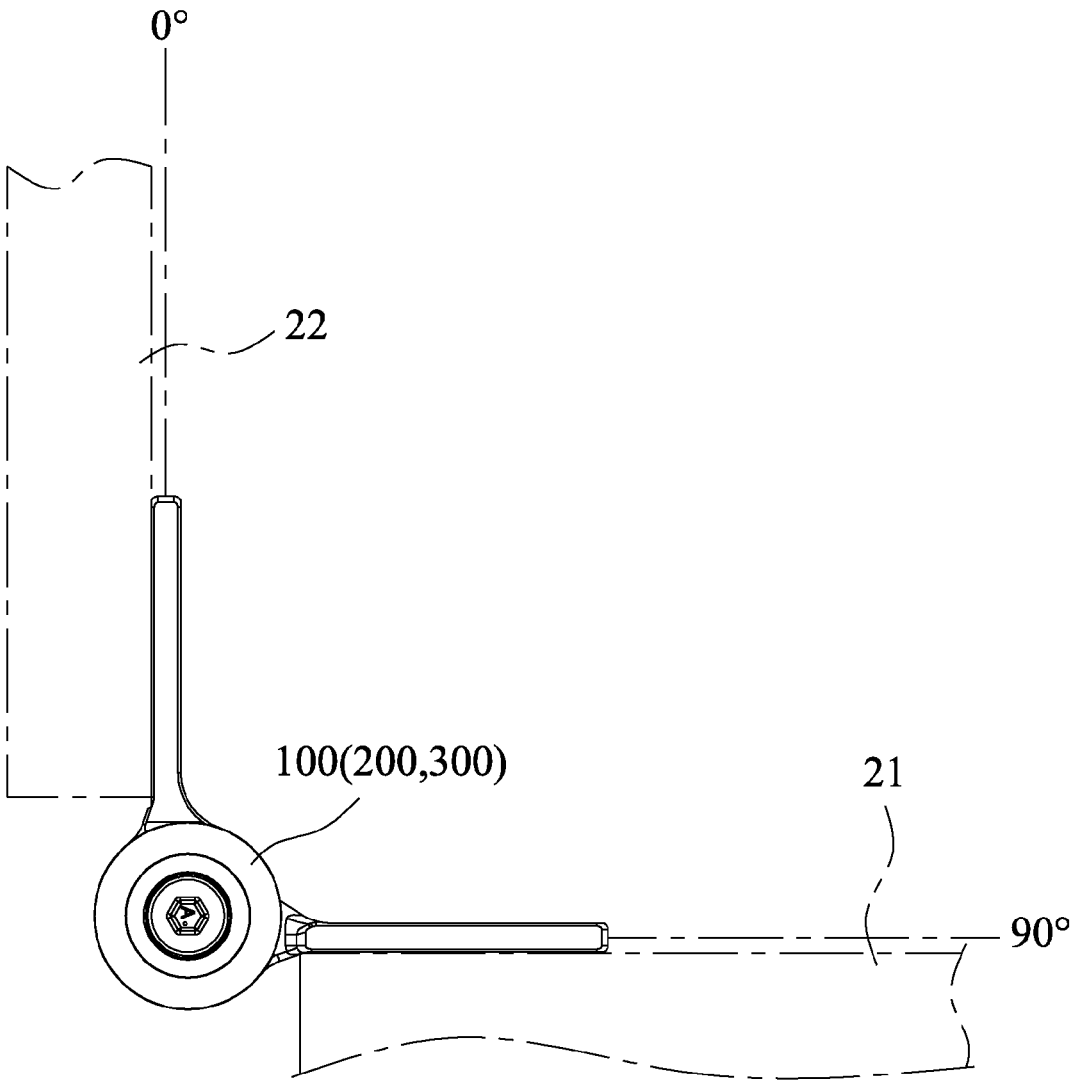
FIG. 15 is a schematic top view illustrating the first embodiment in the open state.

Referring to FIGS. 10 and 15, the first leaf unit 31, the first actuating unit 4 and the damping unit 5 cooperatively form a first hinge assembly 100. In one embodiment, a plurality of the first hinge assemblies 100 may be connected between the first and second objects 21, 22. The damping unit 5 generates a relatively small damping force so as to facilitate the conversion of the first and second objects 21, 22 to a state illustrated in FIG. 15, and generates a much greater damping force when the angle between the first and second leaves 311, 312 is nearly 0 degree so as to prevent severe collision between the first and second objects 21, 22.

Referring to FIG. 11, the first torque-controlling member 43 can be rotated in the first rotational direction relative to the first tubular member 41 by a tool (not shown) to adjust the relative position between the first and second engaging teeth 412, 432 so as to adjust the magnitude of the resultant restoring torque generated by the first torsion spring 44 for collaborating with the damping unit 5.

The mounting bolt 591 can be turned by a tool (not shown) to move the needle 592 relative to the polygonal rod section 563 of the follower member 56 along the axis (X) to adjust the gap between the sleeve piece 595 and the valve seat 571 and the gap defined between the pin 594 and the inner surrounding surface of the needle 592 and corresponding in position to the first communicating hole 5925, so as to adjust the damping force generated by the damping unit 5 during the conversion of the hinge assemblage between the open state and the initial state.

Figure 16:
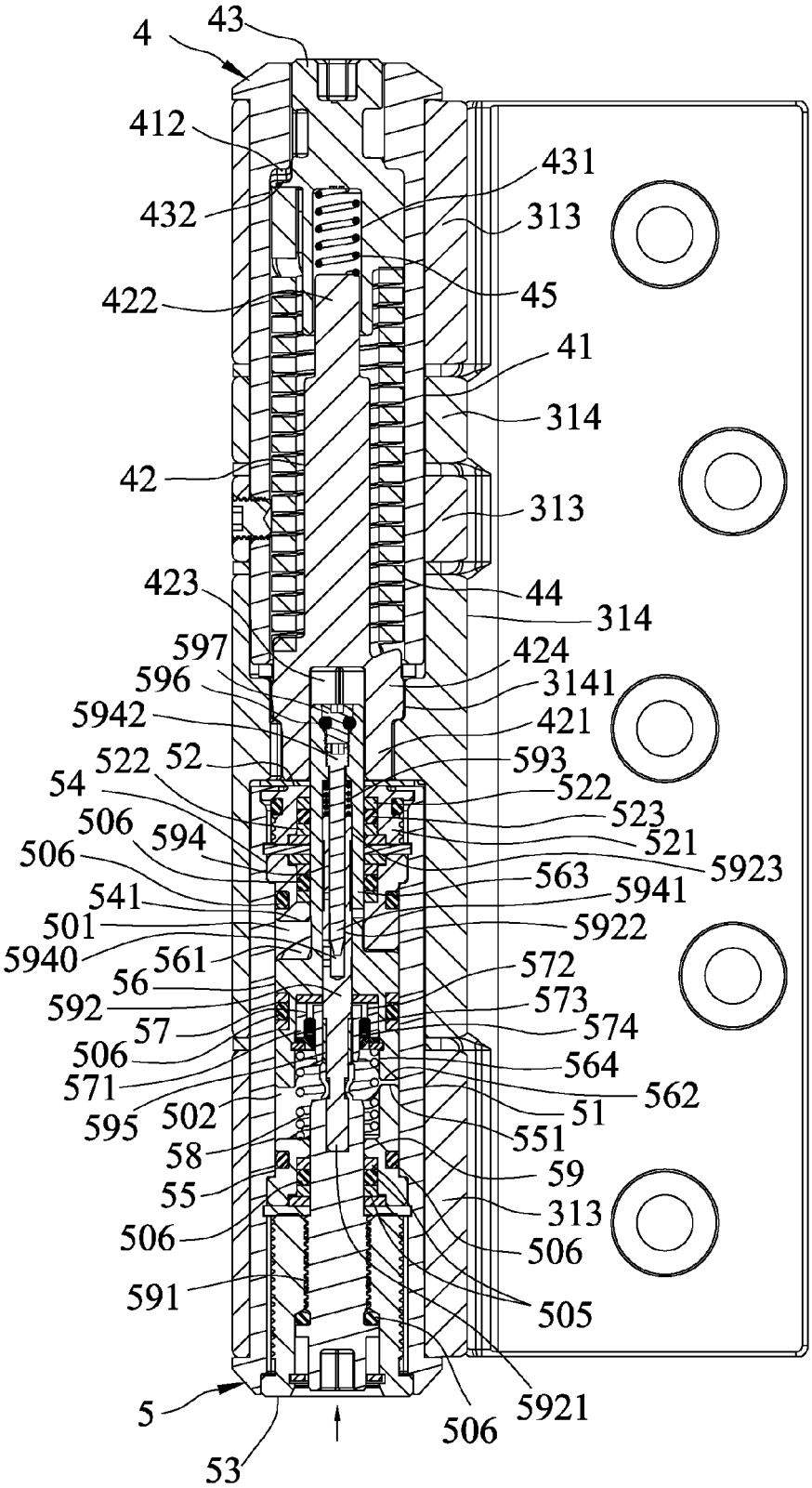
FIG. 16 is a schematic sectional view illustrating the first embodiment in the initial state and a mounting bolt of the throttle assembly being moved to an inner-limit position.
Figure 17:
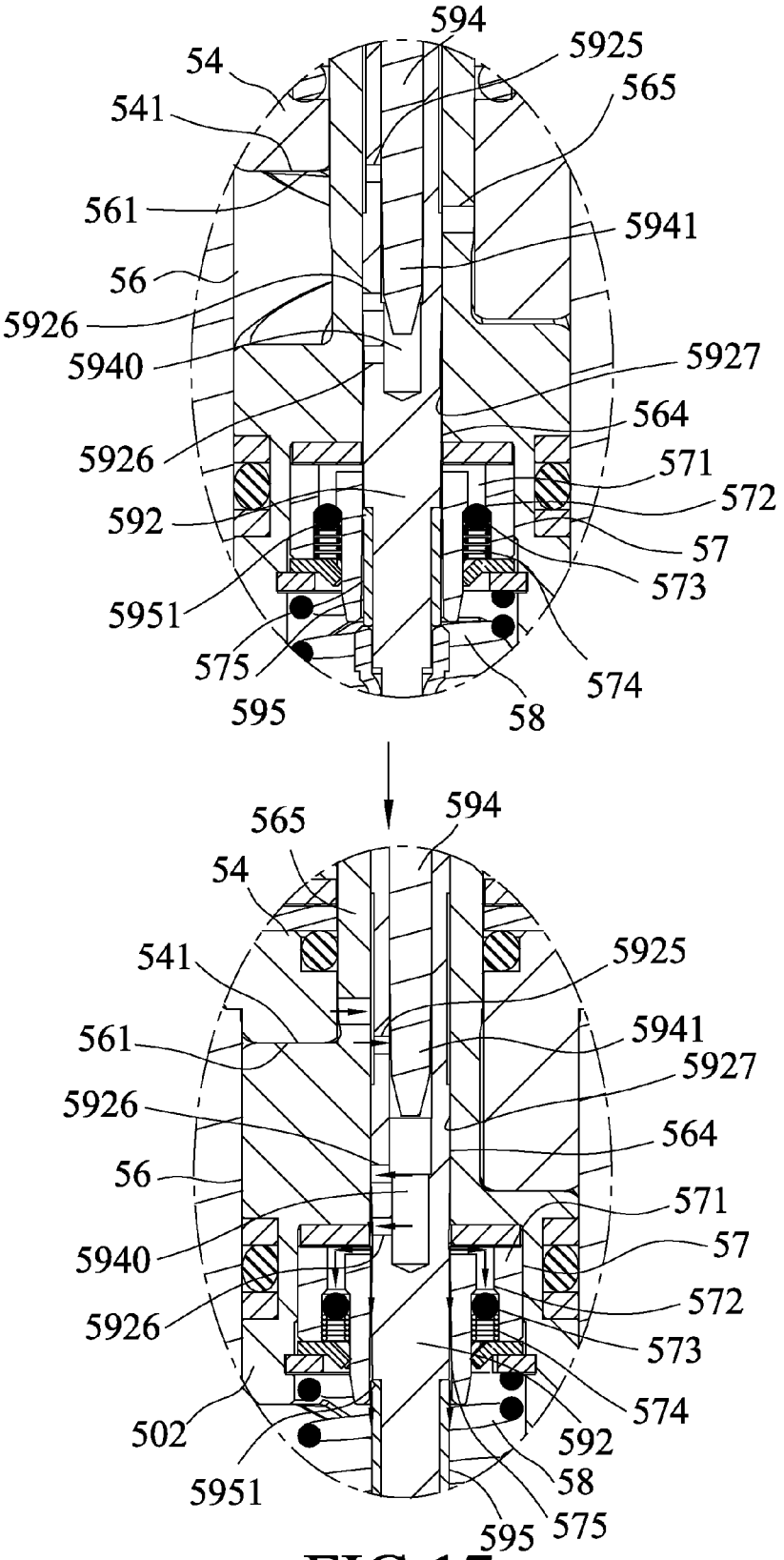
FIG. 17 illustrates the action of the follower member during the conversion of the first embodiment from the initial state to the open state when the mounting bolt of the throttle assembly is at the inner-limit position.

Referring to FIG. 17, the mounting bolt 591 can be turned to move to an inner-limit position relative to the follower member 56 such that the sleeve piece 595 is substantially retained in the valve seat 571 of the one-way valve 57 to considerably narrow the gap between the sleeve piece 595 and the valve seat 571 and the gap defined between the pin 594 and the inner surrounding surface of the needle 592 and corresponding in position to the first communicating hole 5925, so that the first and second leaves 311, 312 are difficult to be pivoted relative to each other. Referring to FIG. 16, if the mounting bolt 591 is turned to move to the inner-limit position relative to the follower member 56 when the hinge assemblage is in the open state, the hinge assemblage can be maintained in the open state when the external forces are removed for repair or other demands.

If the mounting bolt 591 is turned to move to an outer-limit position relative to the follower member 56 so as to considerably enlarge the gap between the sleeve piece 595 and the valve seat 571 and the gap defined between the pin 594 and the inner surrounding surface of the needle 592 and corresponding in position to the first communicating hole 5925, the damping force generated by the damping unit becomes rather small such that the first and second leaves 311, 312 are easy to be pivoted relative to each other.

Figure 19:
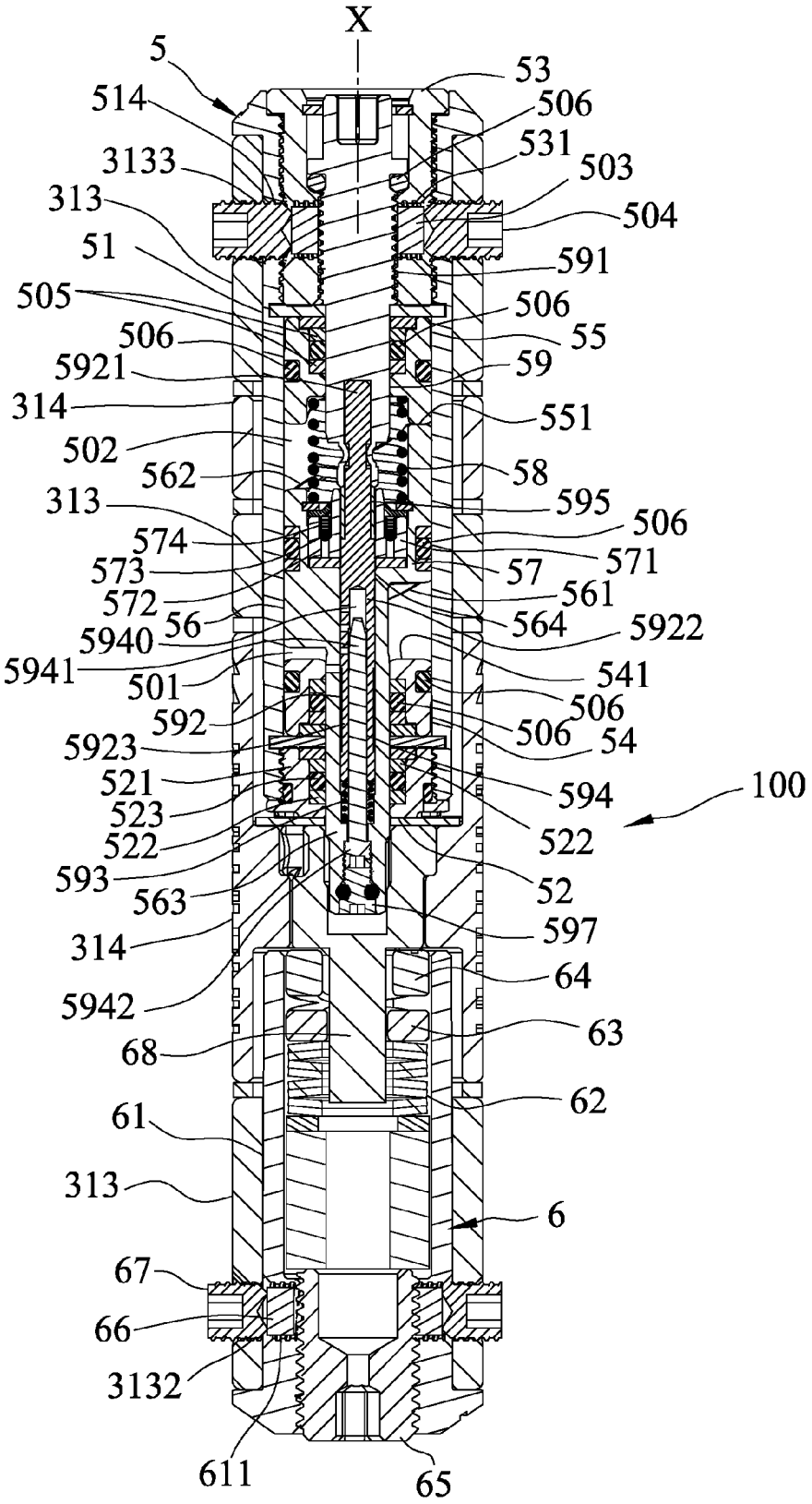
FIG. 19 is a sectional view illustrating a second embodiment of the hinge assemblage according to the disclosure.
Figure 20:
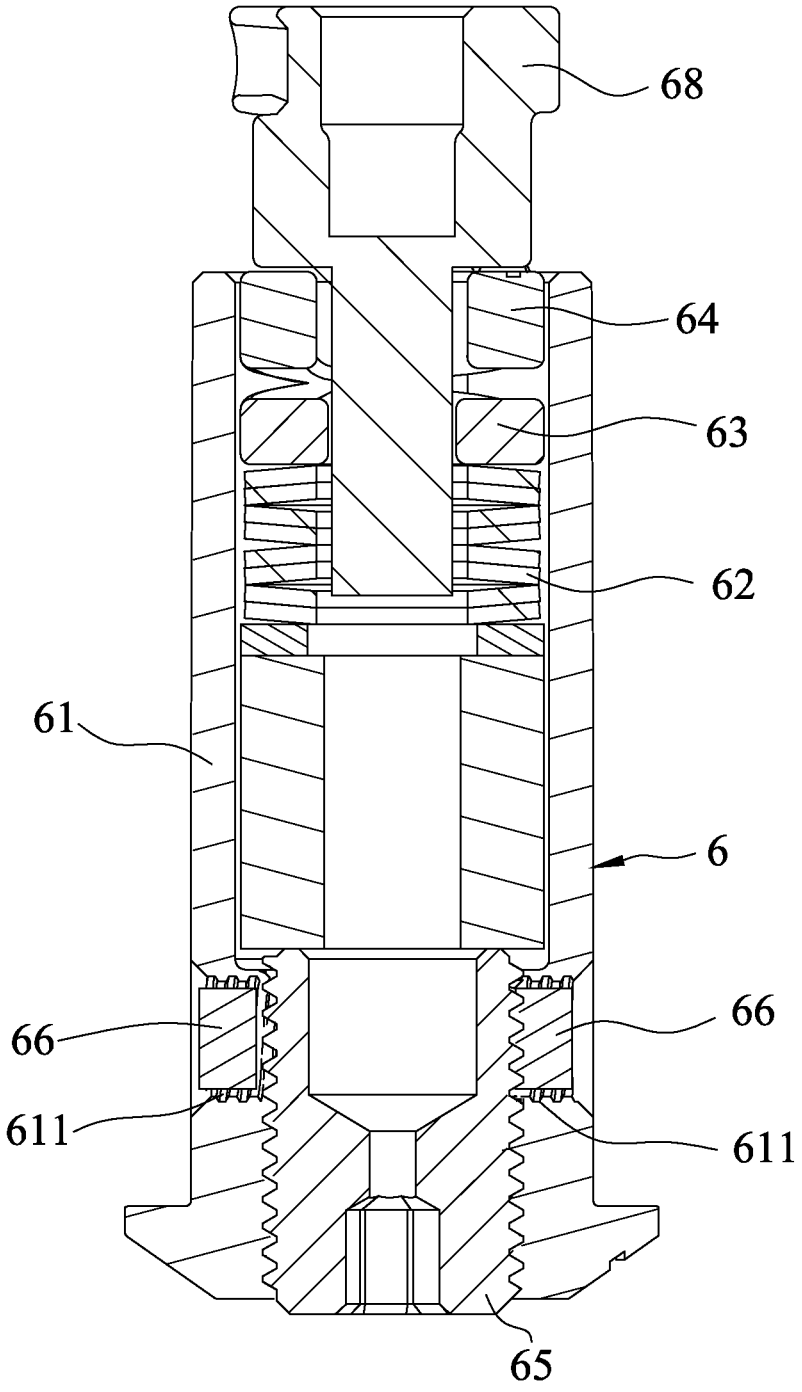
FIG. 20 is a sectional view illustrating a second actuating unit of the second embodiment.

Referring to FIGS. 19 and 20, the second embodiment of the hinge assemblage according to the disclosure includes a leaf mechanism 3, a damping unit 5 and a second actuating unit 6. The leaf mechanism 3 and the damping unit 5 of the second embodiment are similar to that of the first embodiment.

The second actuating unit 6 includes a second tubular member 61 that is inserted into the corresponding first and second barrels 313, 314 and that is co-rotatable with the first leaf 311 and the first barrels 313, a connecting axle 68 that extends into the second tubular member 61 and that is rotatable relative to the second tubular member 61, a friction member 64 that is connected fixedly to the second tubular member 61, a slide sleeve 63 that is co-rotatably sleeved on the connecting axle 68, a spring washer assembly 62 that is disposed in the second tubular member 61 and that pushes the slide sleeve 63 against the friction member 64, a brake-conditioning member 65 that engages threadably the second tubular member 61 and that pushes the spring washer assembly 62 against the slide sleeve 63, two pad members 66 and two bolts 67. The spring washer assembly 62, the slide sleeve 63, the friction member 64 and the brake-conditioning member 65 cooperatively serve as an actuating module.

The second tubular member 61 has two second threaded through holes 611 that are respectively registered with the first threaded through holes 3132 of the corresponding first barrel 313. A frictional force generated between the slide sleeve 63 and the friction member 64 serves as an actuating force for condition of the speed of the relative pivotal movement between the first and second leaves 311, 312. The pad members 66 are respectively disposed in the second threaded through holes 611 of the second tubular member 61. Each of the bolts 67 engages threadably a respective one of the first threaded through holes 3132 of the corresponding first barrel 313 and a corresponding one of the second threaded through holes 611 of the second tubular member 61 to press the corresponding pad member 66 against the brake-conditioning member 65 for preventing relative movement between the brake-conditioning member 65 and the second tubular member 61. The connecting axle 68 extends through the slide sleeve 63 and the friction member 64, engages the limiting grooves 3141 (see FIG. 3) of the corresponding second barrels 314 so as to be co-rotatable with the corresponding second barrels 314, and is co-rotatable with the slide sleeve 63 and the polygonal rod section 563 of the follower member 56 of the damping unit 5.

The first leaf unit 31, the second actuating unit 6 and the damping unit 5 cooperatively form a first hinge assembly 100. The damping unit 5 generates a relatively small damping force so as to facilitate the conversion of the first and second objects 21, 22 to the state illustrated in FIG. 15. During the conversion of the hinge assemblage between the open state and the initial state, the frictional force generated between the slide sleeve 63 and the friction member 64 serves as an actuating force that retards the relative rotation between the follower member 56 and the oil tube 51, so as to condition the speed of the relative pivotal movement between the first and second leaves 311, 312.

The brake-conditioning member 65 can be turned by a tool (not shown) to move relative to the second tubular member 61 to adjust the biasing force exerted by the spring washer assembly 62 so as to adjust the frictional force generated between the slide sleeve 63 and the friction member 64 during the conversion of the hinge assemblage between the open state and the initial state.

Figure 21:
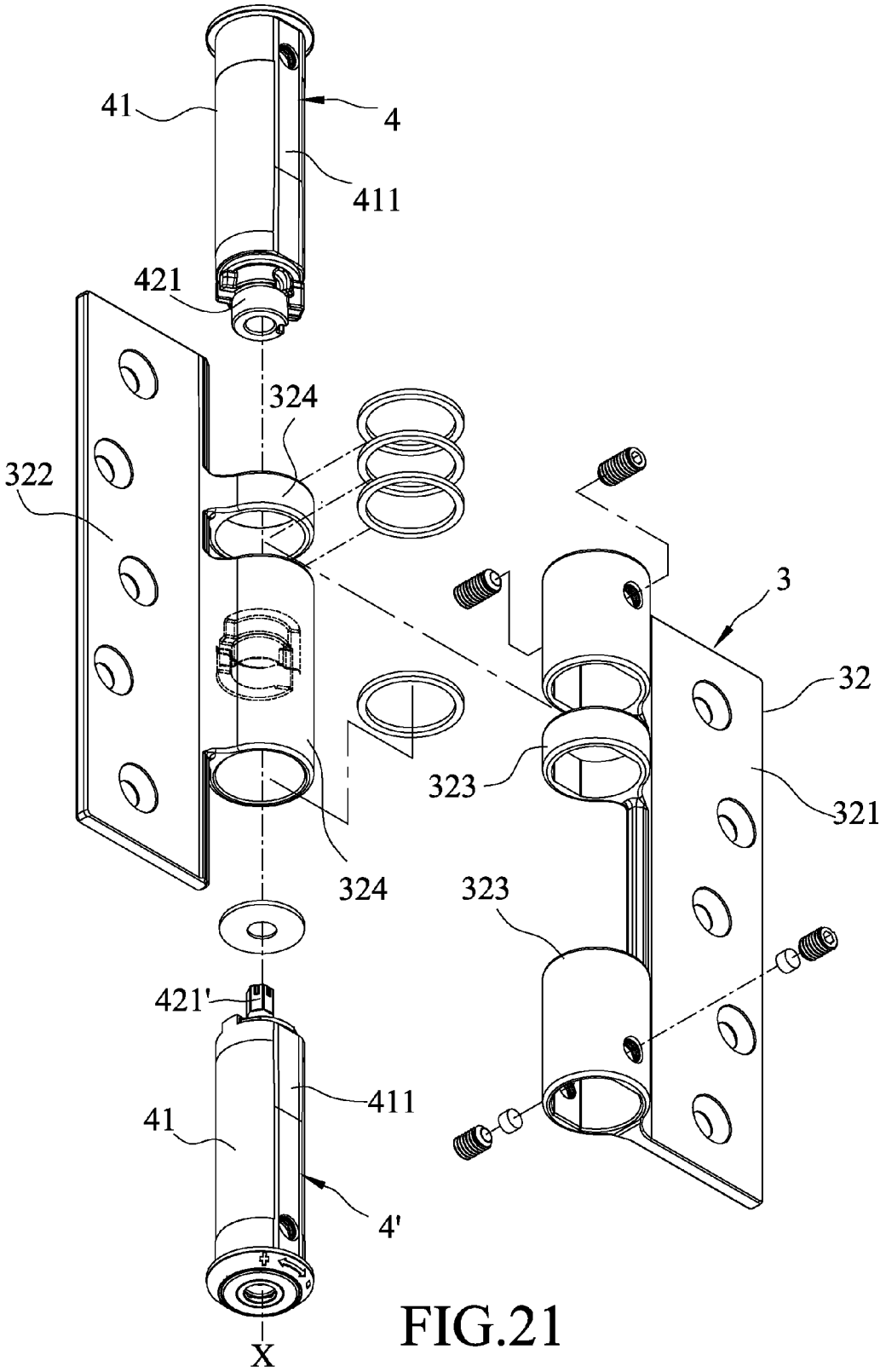
FIG. 21 is a partly exploded perspective view illustrating a third embodiment of the hinge assemblage according to the disclosure.
Figure 22:
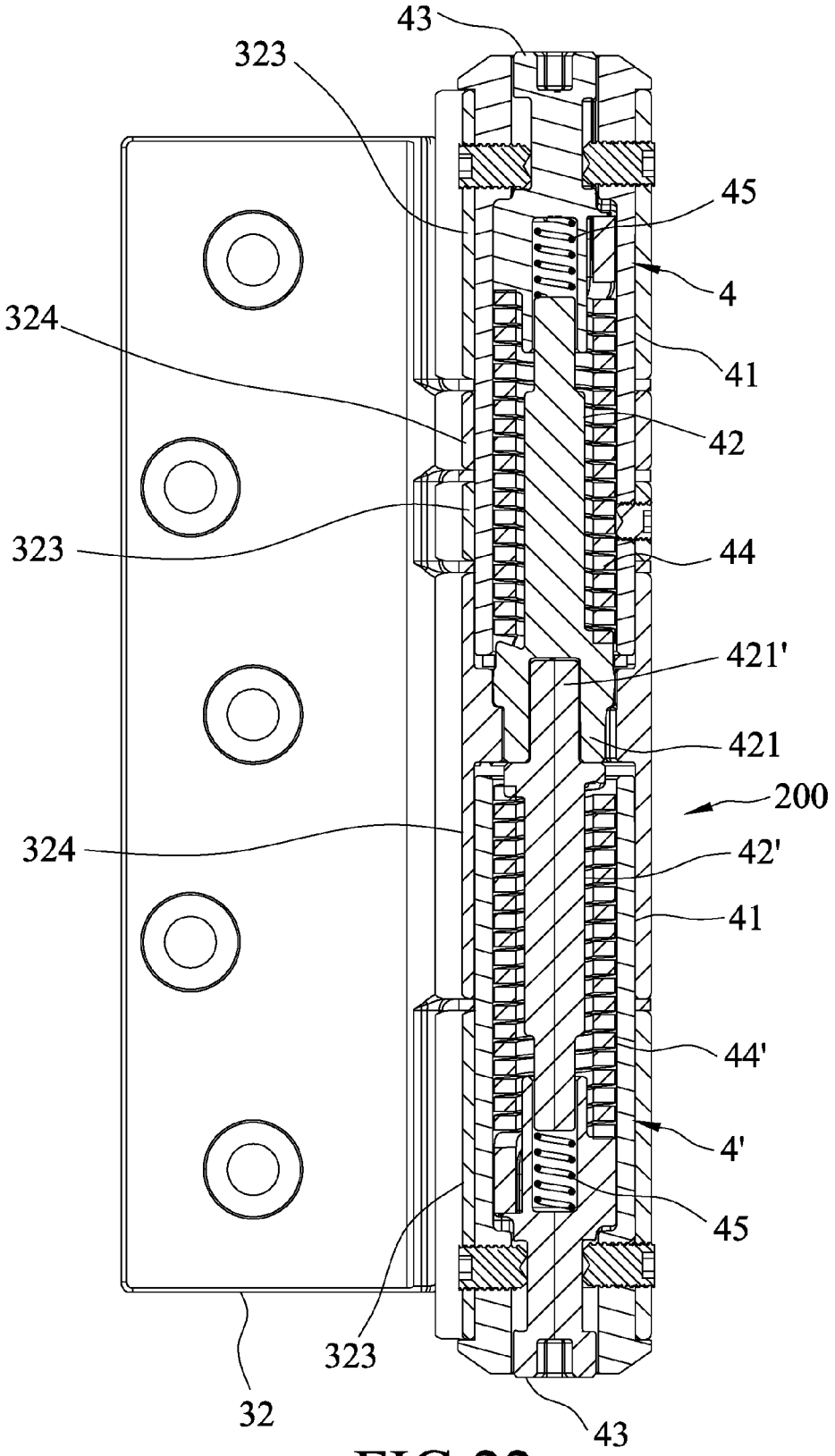
FIG. 22 is a sectional view illustrating the third embodiment.

Referring to FIGS. 21 and 22, the third embodiment of the hinge assemblage according to the disclosure includes a first hinge assembly 100 (see FIG. 11 or 20) and two additional first actuating units 4, 4'. The leaf mechanism 3 of the third embodiment further includes a second leaf unit 32. The second leaf unit 32 and the additional first actuating units 4, 4' cooperatively form a second hinge assembly 200.

Figure 18:
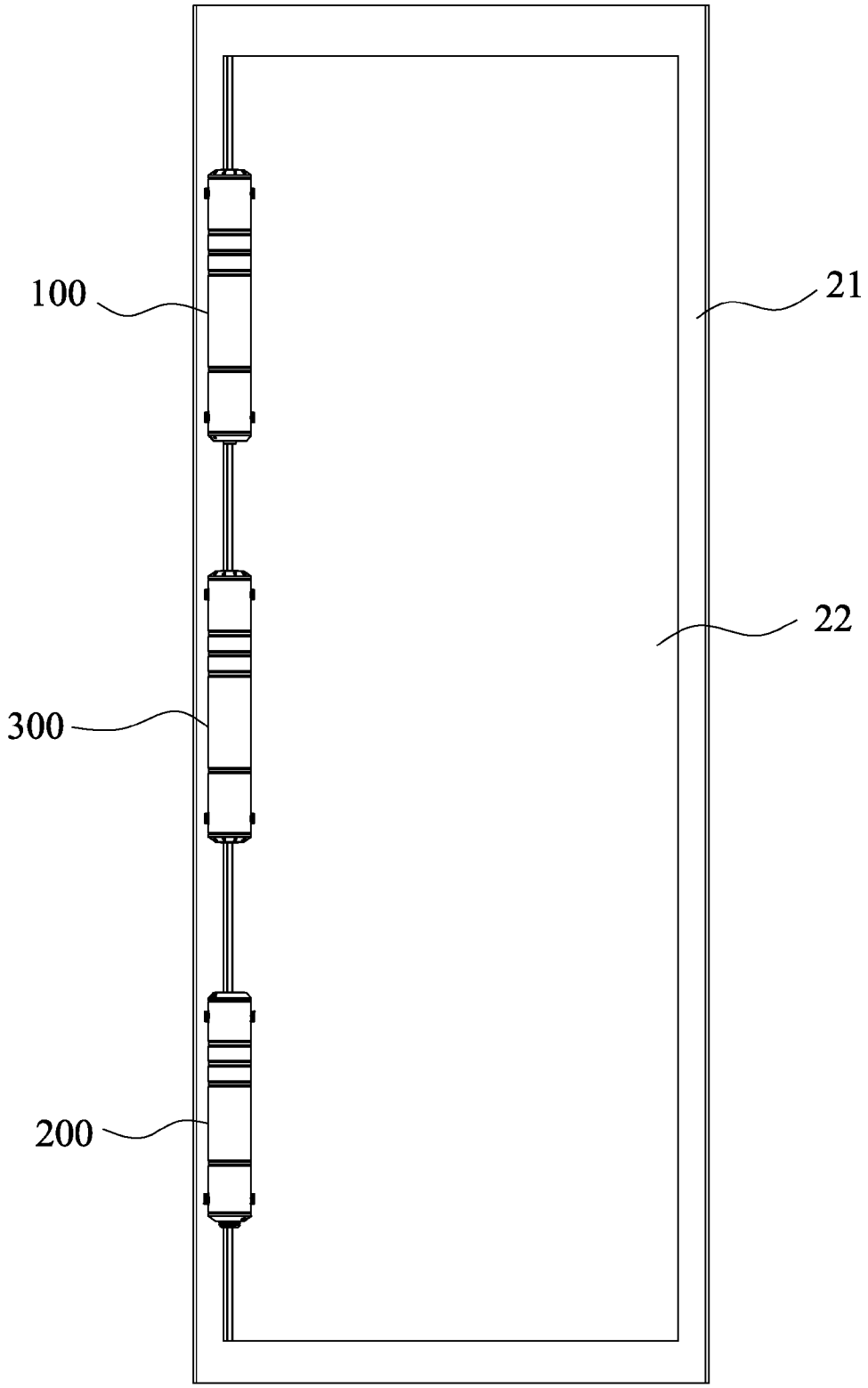
FIG. 18 is a schematic side view illustrating the hinge assemblage according to the disclosure interconnecting first and second objects.

Referring further to FIG. 18, the second leaf unit 32 is similar to the first leaf unit 31, and includes a first leaf 321 fixed to the first object 21, a second leaf 322 fixed to the second object 22, a plurality of first barrels 323 fixed to the first leaf 321, and a plurality of second barrels 324 fixed to the second leaf 322. The first barrels 323 and the second barrels 324 are disposed along an axis (X) in an alternating arrangement.

The additional first actuating units 4, 4' are inserted into the first and second barrels 323, 324. The first tubular members 41 of the additional first actuating units 4, 4' are co-rotatable with the first barrels 323 and the first leaf 321. The first end portions 421, 421' of the connecting axles 42, 42' of the additional first actuating units 4, 4' are co-rotatably interengaged, so that the connecting axles 42, 42' are co-rotatable with the second barrels 324 and the second leaf 322. The first torsion springs 44, 44' of the additional first actuating units 4, 4' are respectively configured as right-hand and left-hand coil springs.

When external forces are applied to pivot the first and second leaves 321, 322 relative to each other about the axis (X), each of the first torsion springs 44, 44' of the additional first actuating units 4, 4' is deformed to exert an actuating force. Therefore, the second hinge assembly 200 is able to provide a resultant restoring torque two times the restoring torque provided by the first hinge assembly 100 in FIG. 11.

Figure 23:
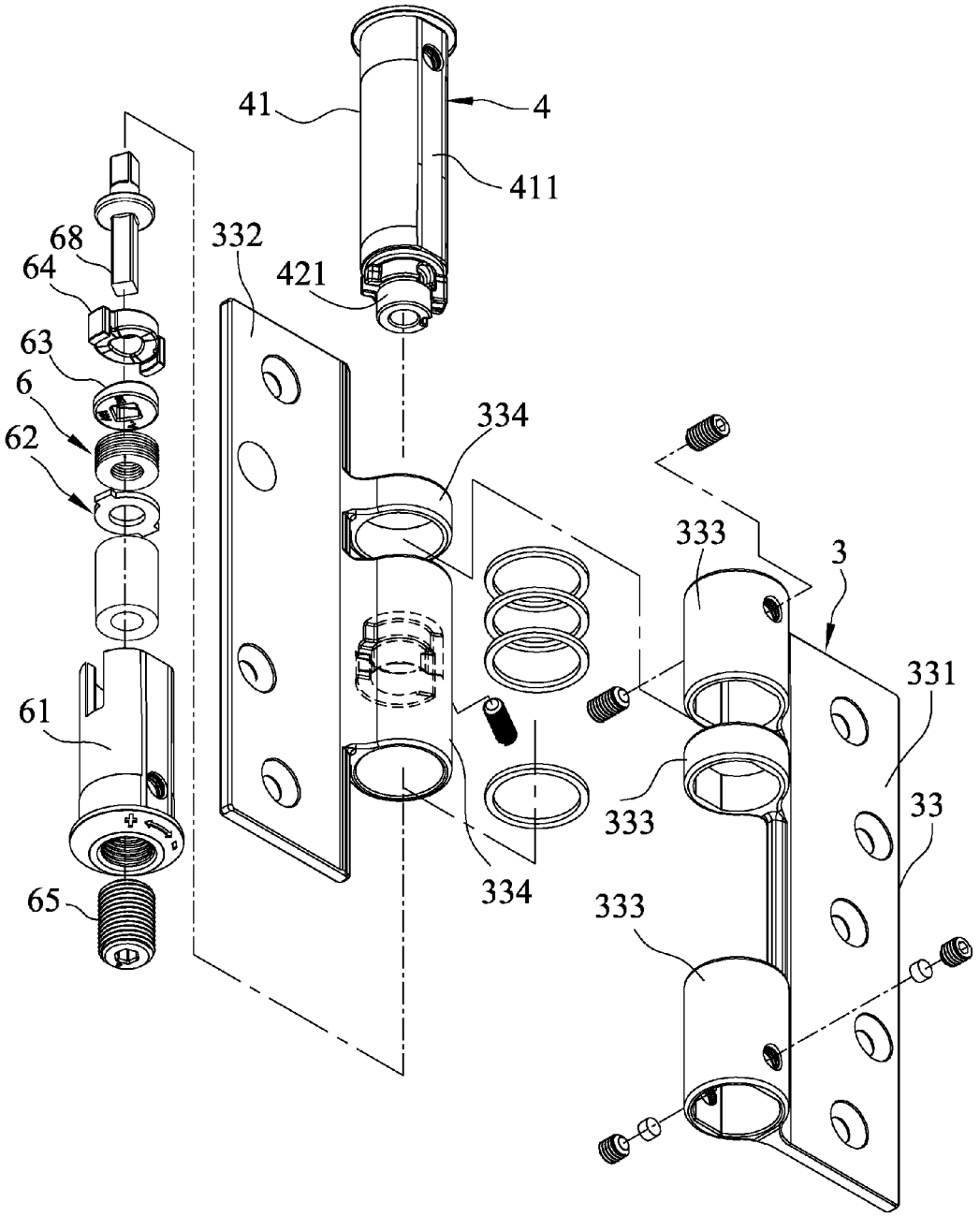
FIG. 23 is a partly exploded perspective view illustrating a fourth embodiment of the hinge assemblage according to the disclosure.
Figure 24:
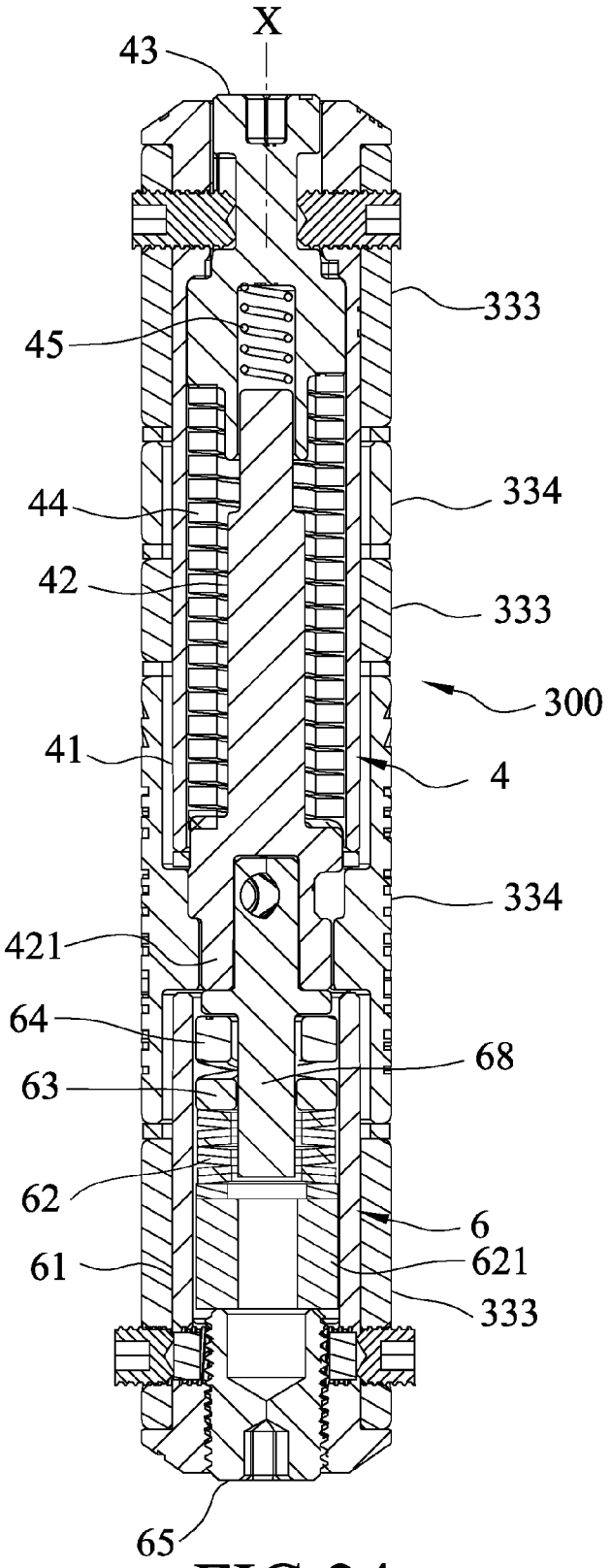
FIG. 24 is a sectional view illustrating the fourth embodiment.
Figure 25:
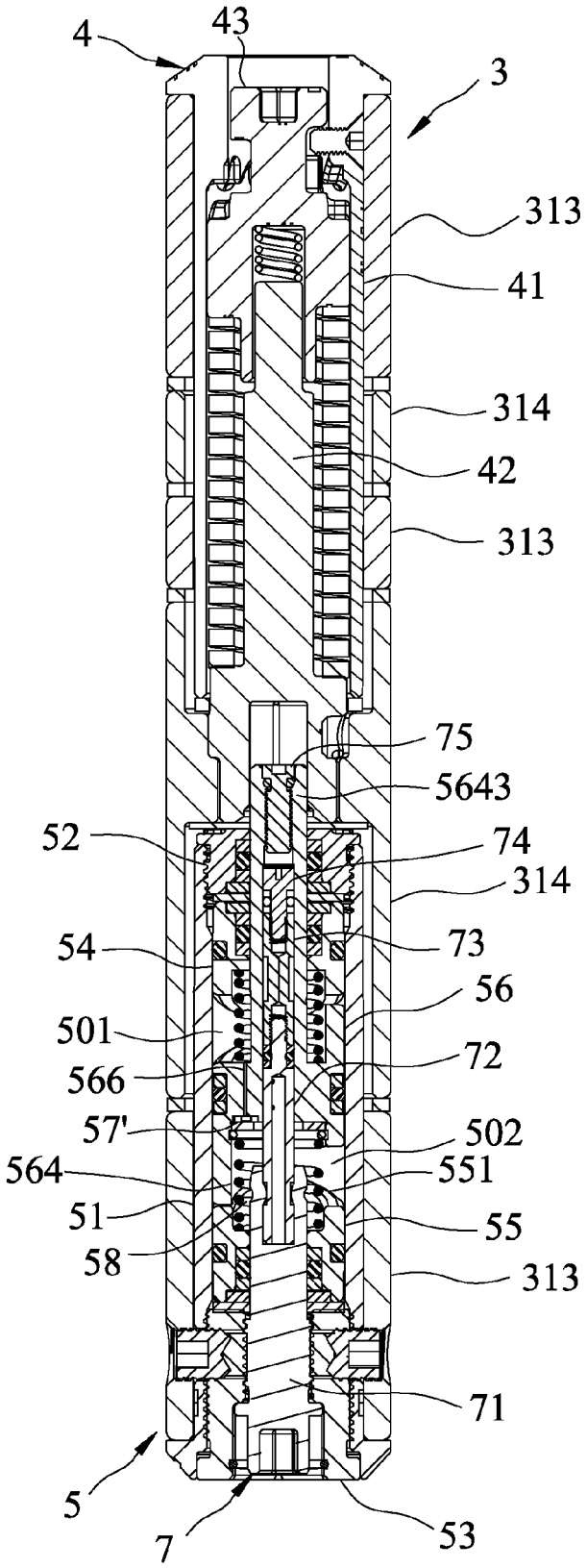
FIG. 25 is a sectional view illustrating a fifth embodiment of the hinge assemblage according to the disclosure.
Figure 26:
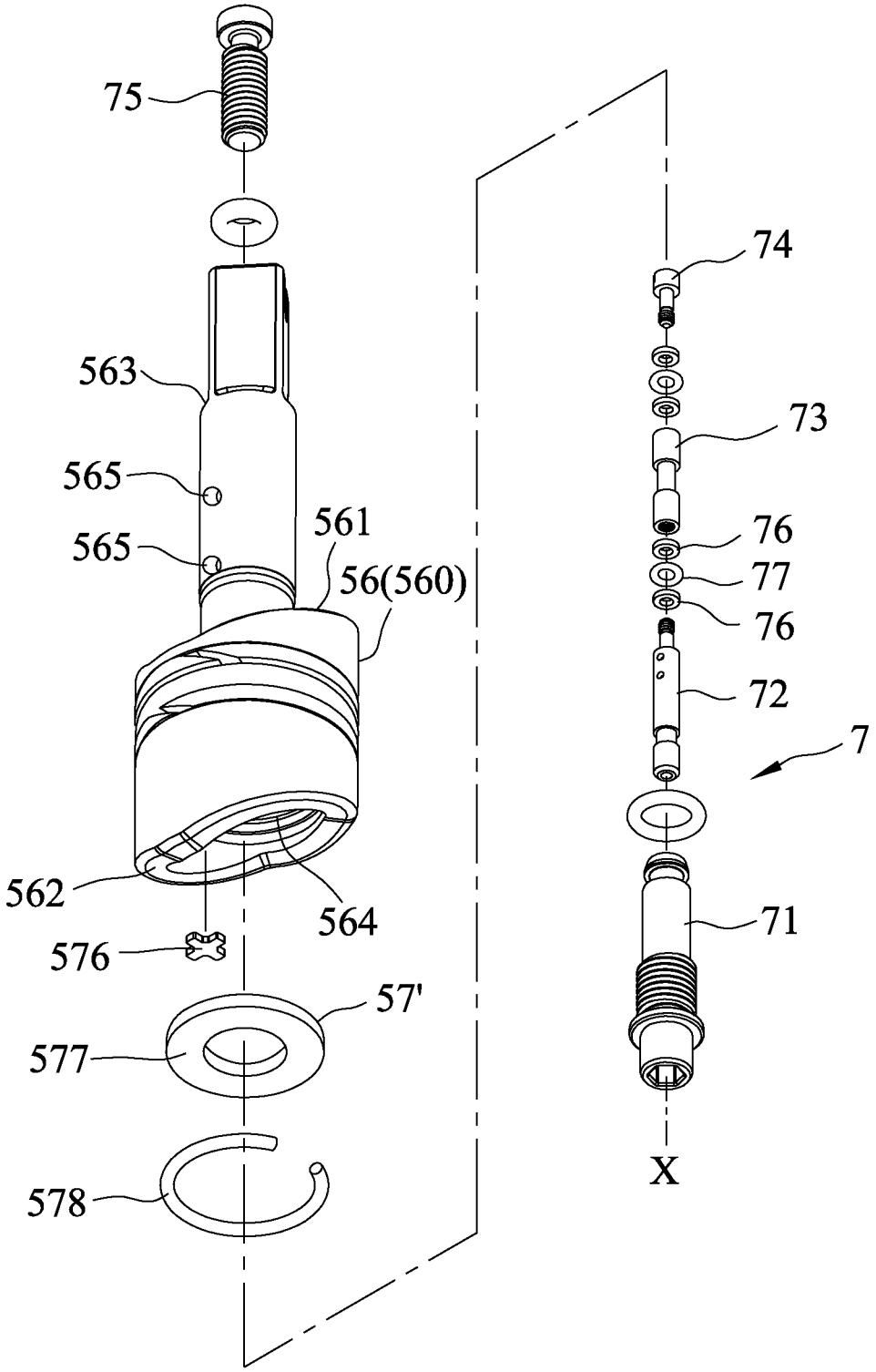
FIG. 26 is an exploded perspective view illustrating a throttle assembly, a one-way valve assembly and a follower member of the fifth embodiment.
Figure 27:
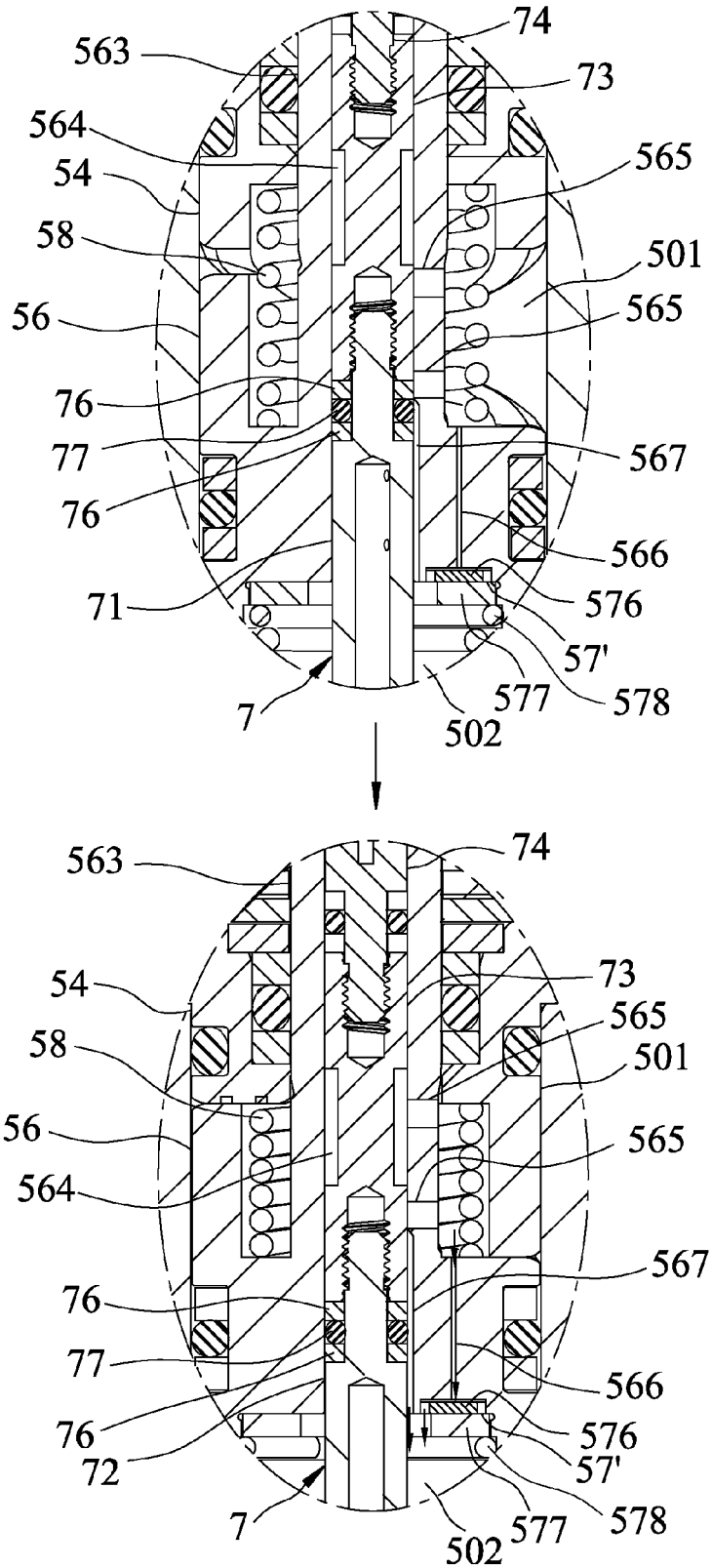
FIG. 27 illustrates the action of the follower member during the conversion of the fifth embodiment from the initial state to the open state.
Figure 28:
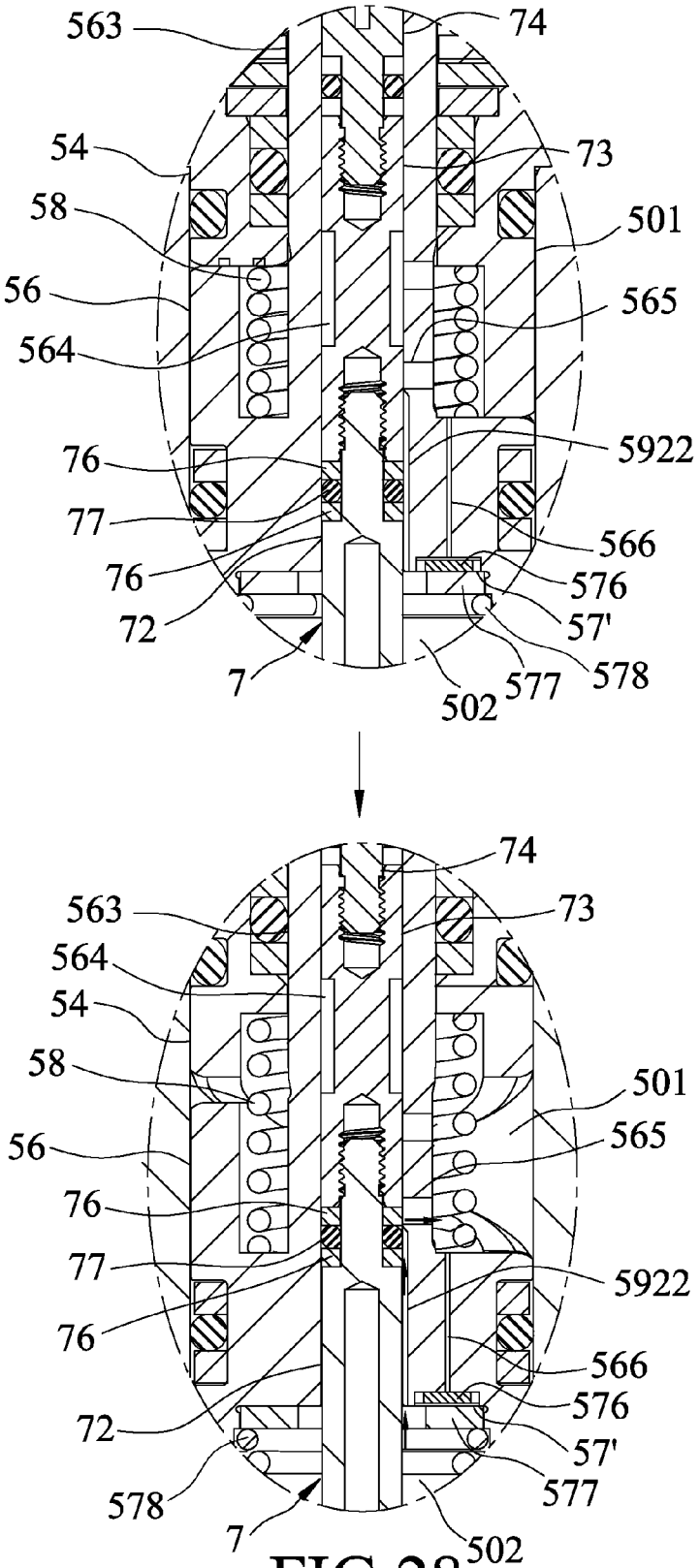
FIG. 28 illustrates the action of the follower member during the conversion of the fifth embodiment from the open state to the initial state.
Figure 29:
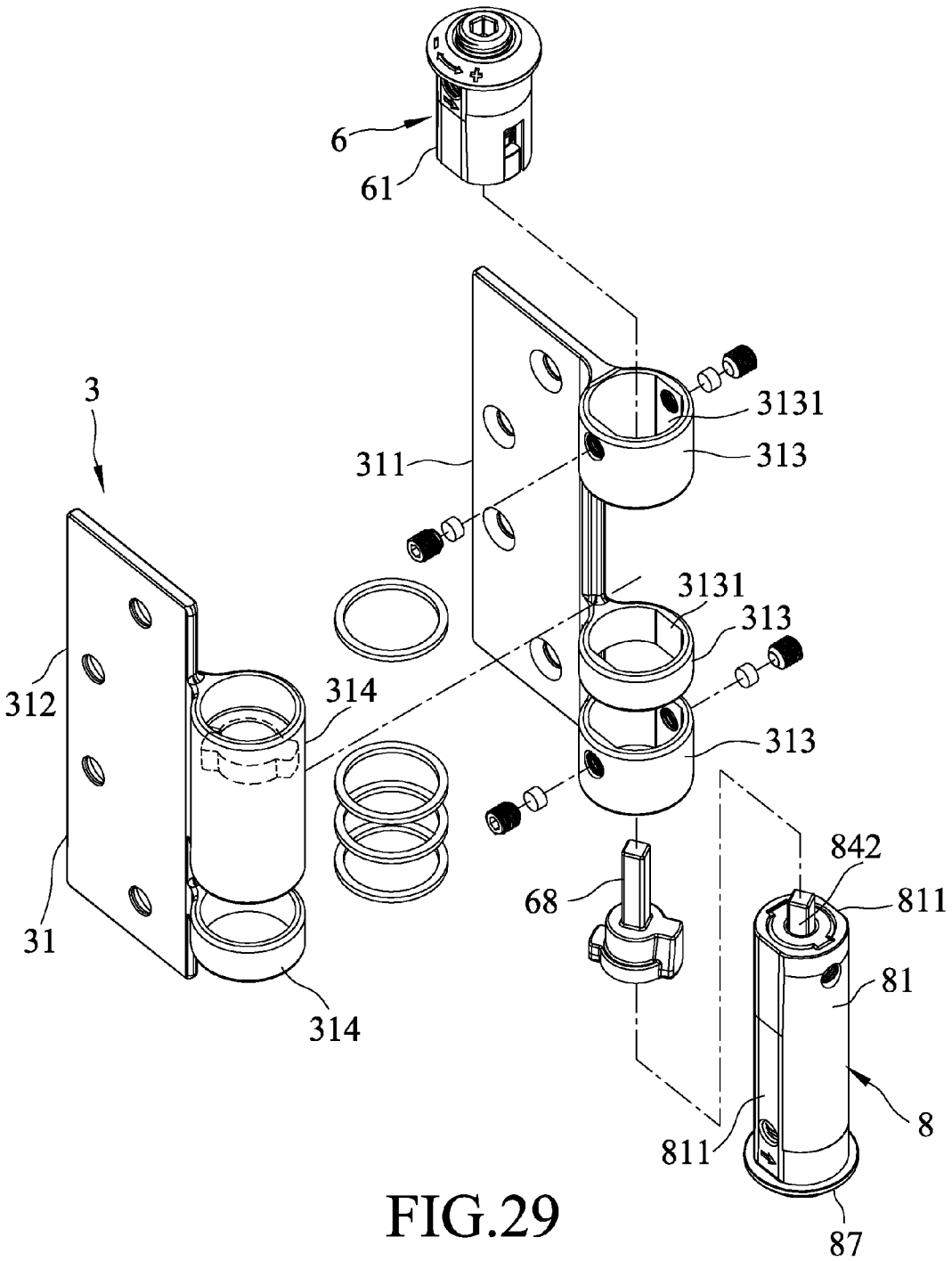
FIG. 29 is a partly exploded perspective view illustrating a sixth embodiment of the hinge assemblage according to the disclosure.
Figure 30:
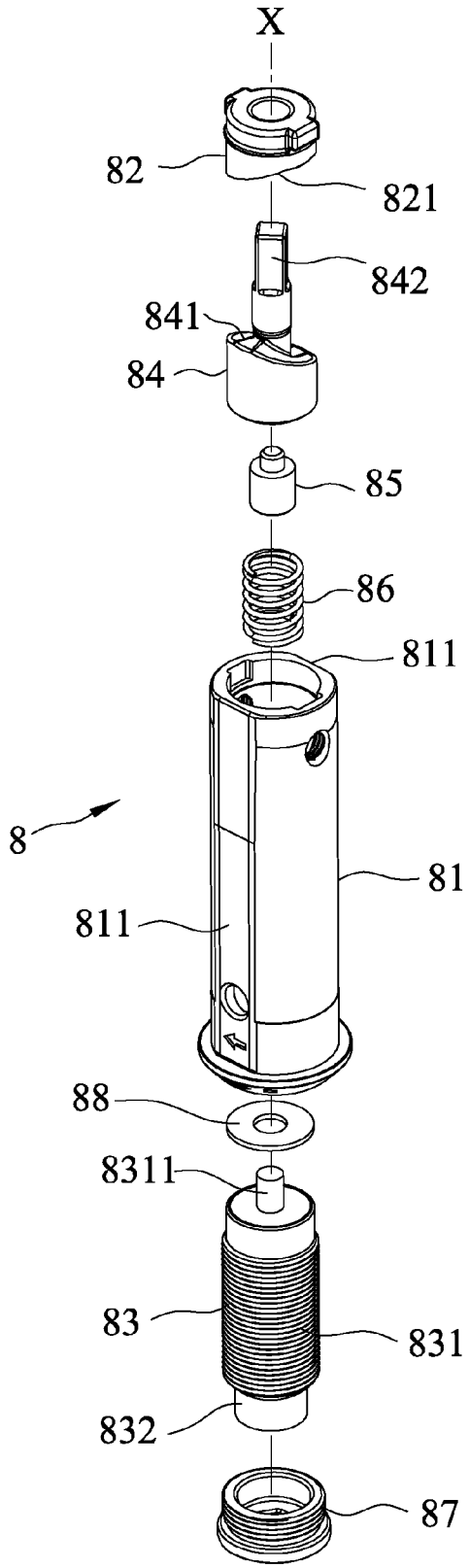
FIG. 30 is an exploded perspective view illustrating a damping unit of the sixth embodiment.
Figure 31:
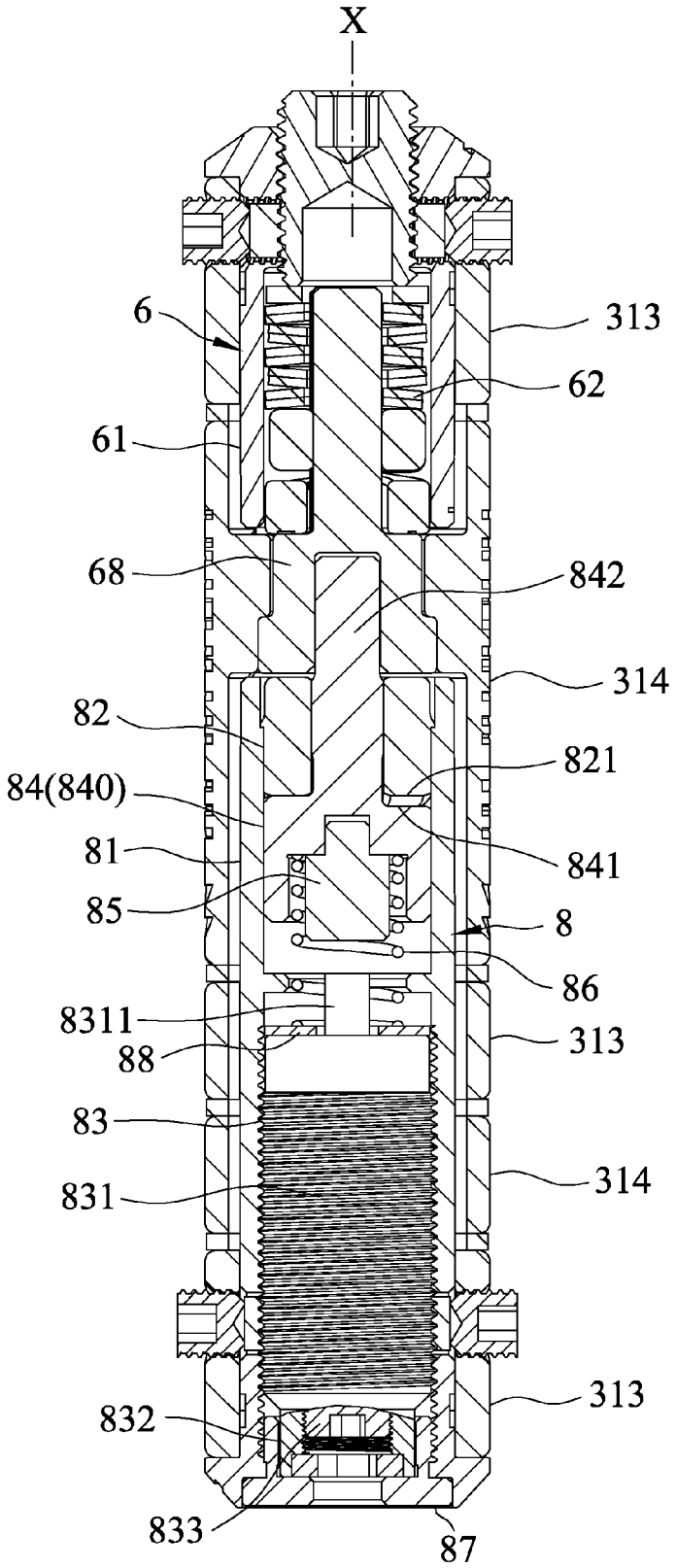
FIG. 31 is a schematic sectional view illustrating the sixth embodiment in the open state.
Figure 32:
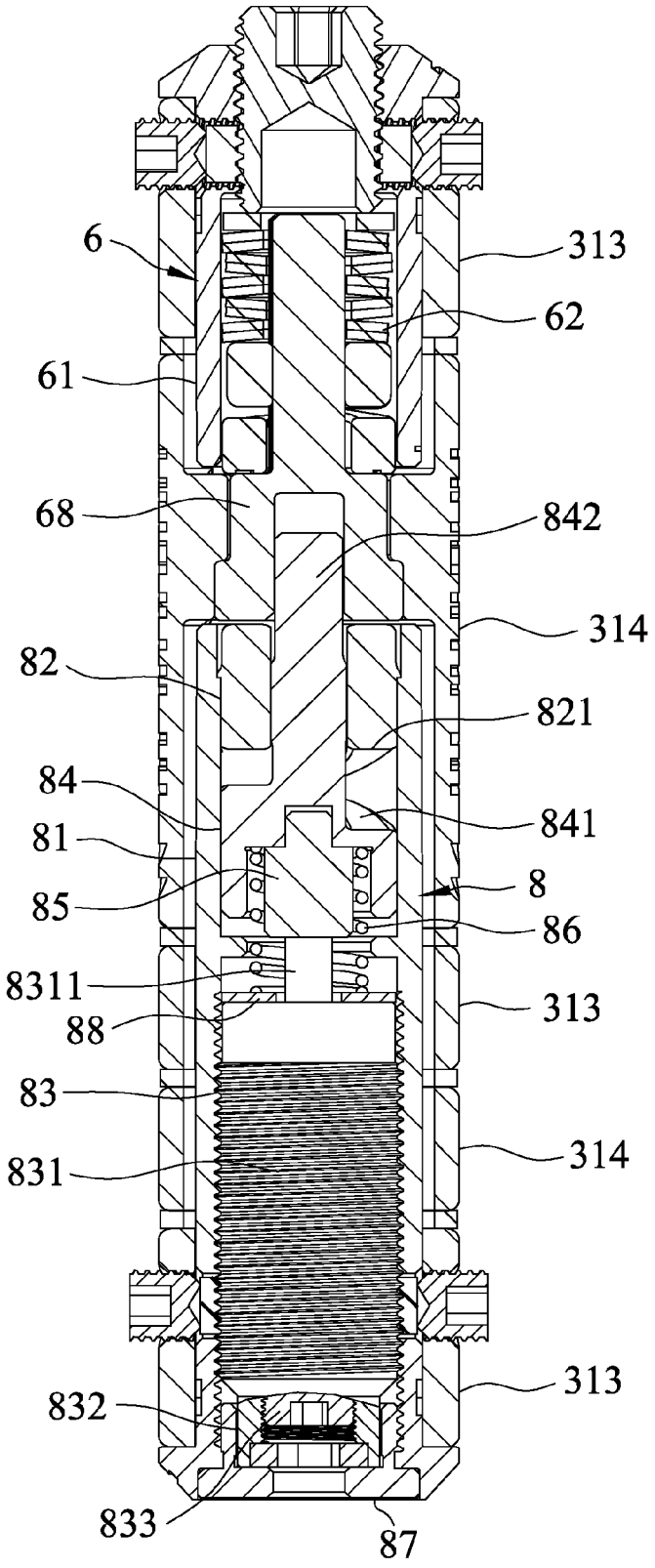
FIG. 32 is another schematic sectional view illustrating the sixth embodiment in the initial state.

Referring to FIGS. 23 and 24, the fourth embodiment of the hinge assemblage according to the disclosure includes a first hinge assembly 100 (see FIG. 11 or 20), an additional first actuating unit 4 and an additional second actuating unit 6. The leaf mechanism 3 of the fourth embodiment further includes a third leaf unit 33. The third leaf unit 33 and the additional first and second actuating units 4, 6 cooperatively form a third hinge assembly 300.

Referring further to FIG. 18, the third leaf unit 33 is similar to the first leaf unit 31, and includes a first leaf 331 fixed to the first object 21, a second leaf 332 fixed to the second object 22, a plurality of first barrels 333 fixed to the first leaf 331, and a plurality of second barrels 334 fixed to the second leaf 332. The first barrels 333 and the second barrels 334 are disposed along an axis (X) in an alternating arrangement.

The additional first actuating unit 4 is inserted into the corresponding first and second barrels 333, 334. The first tubular member 41 of the additional first actuating unit 4 is co-rotatable with the first leaf 331 and the first barrels 333. The connecting axle 42 of the additional first actuating unit 4 is co-rotatable with the second leaf 332 and the second barrels 334.

The second tubular member 61 of the additional second actuating unit 6 is inserted into the corresponding first and second barrels 333, 334, and is co-rotatable with the first leaf 331 and the first barrels 333. The connecting axle 68 of the additional second actuating unit 6 extends through the friction member 64 and the slide sleeve 63 to engage the first end portion 421 of the connecting axle 42 of the additional first actuating unit 4, and is co-rotatable with the connecting axle 42 and the slide sleeve 63 about the axis (X).

When external forces are applied to pivot the first and second leaves 321, 322 relative to each other about the axis (X), the first torsion springs 44 of the additional first actuating unit 4 is deformed to exert an actuating force so as to generate a resultant restoring torque. The spring washer assembly 62 pushes the slide sleeve 63 against the friction member 64 to generate a frictional force between the slide sleeve 63 and the friction member 64 that serves as another actuating force for retarding the relative rotation between the first tubular member 41 and the connecting axle 42 of the additional first actuating unit 4, so as to condition the speed of the relative pivotal movement between the first and second leaves 311, 312.

It should be noted that, in one embodiment, the hinge assemblage of this disclosure may include any number of the first, second and third hinge assembles 100, 200, 300 so as to pivotally interconnect the first and second objects 21, 22.

Referring to FIGS. 25 to 28, the fifth embodiment of the hinge assemblage according to the disclosure is similar to the first embodiment, and includes a leaf mechanism 3, a first actuating unit 4 and a damping unit 5. The damping unit 5 further includes a one-way valve assembly 57' and a throttle assembly 7 to respectively substitute the one-way valve assembly 57 and the throttle assembly 59 of the first embodiment (see FIG. 3).

The follower member 56 further has an oil path 566 that is formed through the main body 560 and that fluidly communicates with the first and second oil chambers 501, 502, an oil groove 567 that is formed in the inner surface of the follower member 56 and that fluidly communicates with the second oil chamber 502, and two communicating holes 565 that are formed in the polygonal rod section 563 and that fluidly communicate with the communicating passage 564 formed therethrough and the first oil chamber 501.

The one-way valve assembly 57' includes a valve member 576, an annular gasket 577 and a positioning ring 578. The valve member 576 may be configured as a plate, a bolt or a ball. The positioning ring 578 positions the annular gasket 577 relative to the follower member 56, such that the valve member 576 is permitted to move within a space defined between the follower member 56 and the annular gasket 577 for removably blocking the oil path 566.

The throttle assembly 7 extends along the axis (X) through the sleeve member 53, the second acting member 55, the follower member 56 and the one-way valve assembly 57', and includes a mounting bolt 71, a first needle 72, a second needle 73, a pin 74, a securing member 75, two back-up rings 76 and a sealing ring 77. The mounting bolt 71 extends along the axis (X) through the second acting member 55 and the sleeve member 53, and engages threadably the sleeve member 53. The first needle 72 is movably mounted to the mounting bolt 71 and extends along the axis (X) into the follower member 56. The second needle 73 is disposed in the communicating passage 564 of the follower member 56, and is threaded to the first needle 72. The pin 74 is threaded to the second needle 73. The securing member 75 is threaded to the inner threaded portion 5643 of the follower member 56. The back-up rings 76 are disposed between the first and second needles 72, 73. The sealing ring 77 is forcibly clamped between the back-up rings 76 for air-tight contact with the inner surface of the follower member 56. The follower member 56 and the throttle assembly 7 are configured such that the fluid communication between the oil groove 567 and one of the communicating holes 565 proximate to the oil groove 567 is permitted so as to form an oil passageway when the one of the communicating holes 565 corresponds in position to the back-up rings 76 and the sealing ring 77, and the fluid communication between the oil groove 567 and the one of the communicating holes 565 is blocked when the one of the communicating holes 565 corresponds in position to an outer surrounding surface of the second needle 73. The one-way valve assembly 57' and the throttle assembly 7 cooperatively serve as a hydraulic module.

When external forces are applied to pivot the first and second leaves 311, 312 relative to each other such that the hinge assemblage is converted from the initial state to the open state, the follower member 56 is pushed by the cam surface 551 of the second acting member 55 to compress the first oil chamber 501. At this time, the oil in the first oil chamber 501 flows into the second oil chamber 502 via the oil path 566 and via the one of the communicating holes 565 and the oil groove 567 until the one of the communicating holes 565 corresponds in position to the outer surrounding surface of the second needle 73. The oil flowing from the first oil chamber 501 and through the oil path 566 pushes the valve member 576 so as to unblock the oil path 566.

When the external forces are removed, the cam surface 541 of the first acting member 54 pushes the follower member 56 toward the second acting member 55 so as to compress the second oil chamber 502. The oil in the second oil chamber 502 is prevented from flowing into the oil path 566 by the valve member 576, and is only permitted to flow into the first oil chamber 501 via the oil groove 567 and the one of the communicating holes 565 corresponds in position to the back-up rings 76 and the sealing ring 77. As a result, the damping force generated by the hydraulic module during the conversion of the hinge assemblage from the open state to the initial state is greater than the damping force generated by the hydraulic module during the conversion of the hinge assemblage from the initial state to the open state.

It should be noted that, during the conversion of the hinge assemblage from the open state to the initial state, if the first and second leaves 311, 312 cannot pivot relative to each other due to the misalignment among the one of the communicating holes 565 and the back-up rings 76 and the sealing ring 77, the mounting bolt 71 can be turned to move relative to the follower member 56 so as to move the back-up rings 76 and the sealing ring 77 to correspond in position to the one of the communicating holes 565, and to permit the fluid communication between the oil groove 567 and the one of the communicating holes 565.

Referring to FIGS. 29 to 32, the sixth embodiment of the hinge assemblage according to the disclosure includes a leaf mechanism 3 that includes a first leaf unit 31, a second actuating unit 6 and a damping unit 8.

The damping unit 8 includes an oil tube 81, a first acting member 82, a hydraulic module 83, a follower member 84, a spacing block 85, an oil spring 86, a cap 87 and a washer 88.

The oil tube 81 is inserted into the corresponding first and second barrels 313, 314, and has two diametrically opposite limiting surface portions 811 that are formed on an outer surface thereof, and that respectively abut against the limiting surface portions 3131 of each of the corresponding first barrels 313, such that the oil tube 81 is co-rotatable with the first barrels 313 and the first leaf 311.

The first acting member 82 is disposed fixedly in the oil tube 81, and has an inclined cam surface 821.

The hydraulic module 83 includes a main body 831 that is movably threaded within the oil tube 81, a sleeve 832 that is connected fixedly to an end of the main body 831 distal from the first acting member 82, and an adjusting bolt 833 that engages threadably the sleeve 832. The main body 831 has a protrusion 8311 that protrudes toward the first acting member 82 for being depressed, such that the main body 831 generates a damping force upon the depression of the protrusion 8311. The sleeve 832 is for being operated to move the main body 831 relative to the oil tube 81, so as to adjust a distance between the protrusion 8311 and the first acting member 82. The adjusting bolt 833 can be turned by a tool (not shown) to move relative to the sleeve 832, so as to adjust the damping coefficient of the main body 831 to adjust the magnitude of the damping force generated by the main body 831 upon the depression of the protrusion 8311.

The follower member 84 is movable relative to the oil tube 81 along the axis (X), and has a main body 840 that is disposed between the first acting member 82 and the hydraulic module 83 and that has an abutment surface 841 facing toward the cam surface 821 of the first acting member 82, and a polygonal rod section 842 that extends out of the oil tube 81 through the first acting member 82, and that is coupled to the connecting axle 68 of the second actuating unit 6 in such a manner that the polygonal rod section 842 and the connecting axle 68 are co-rotatable about the axis (X), and are movable relative to each other along the axis (X). Therefore, the follower member 84 is co-rotatable with the second barrels 314 about the axis (X).

The spacing block 85 is connected fixedly to the follower member 84 for depressing the protrusion 8311 of the hydraulic module 83 upon the movement of the follower member 84 relative to the oil tube 81.

The oil spring 86 resiliently biases the follower member 84 toward the first acting member 82.

The cap 87 is mounted to an end of the oil tube 81 distal from the first acting member 82.

The washer 88 has opposite ends respectively abutting against the main body 831 of the hydraulic module 83 and the oil spring 86.

When the hinge assemblage is converted from the open state (see FIG. 31) to the initial state (see FIG. 32), the cam surface 821 of the first acting member 82 pushes the abutment surface 841 of the follower member 84 so as to move the follower member 84 toward the protrusion 8311 of the hydraulic module 83. When the hinge assemblage is converted from the initial state (see FIG. 32) to the open state (see FIG. 31), the first acting member 82 is rotated relative to the follower member 84 so as to permit the follower member 84 to be moved away from the hydraulic module 83 by the oil spring 86. Therefore, the hydraulic module 83 is for damping the movement of the follower member 84 when the hinge assemblage is converted from the open state to the initial state, and would not damp the movement of the follower member 84 away from the hydraulic module 83.

Figure 33:
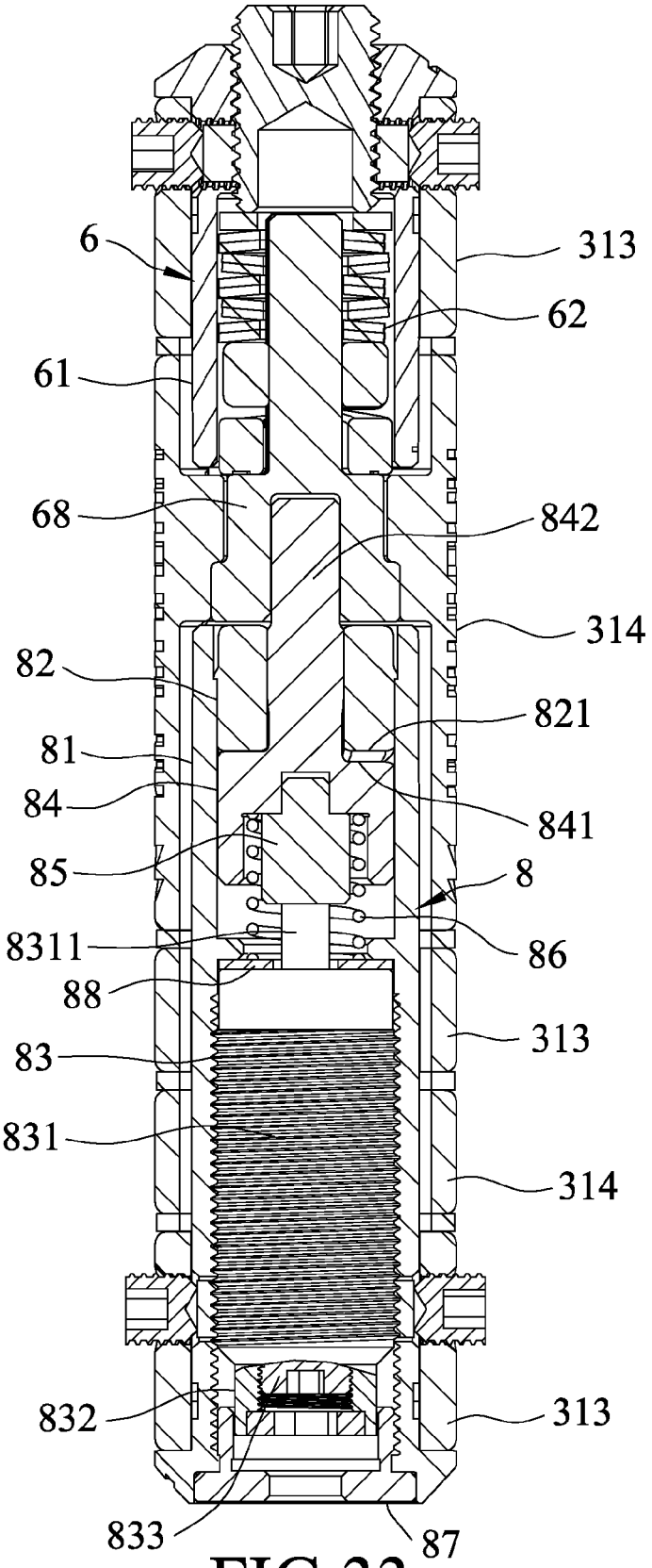
FIG. 33 is still another schematic sectional view illustrating the sixth embodiment in the open state.

Moreover, the sleeve 832 can be turned by a tool (not shown) to move the main body 831 toward the spacing block 85, so that the spacing block 85 and the protrusion 8311 are in contact when the first and second leaves 311, 312 are rotated to form a predetermined angle therebetween. Upon the adjustment of the relative position of the main body 831, during the conversion of the hinge assemblage from the open state to the initial state, the follower member 84 may move the spacing block 85 to depress the protrusion 8311 so that the main body 831 generates a damping force for preventing severe collision between the first and second objects 21, 22 when the angle between the first and second leaves 311, 312 is nearly 0 degree (see FIG. 32), or when the angle between the first and second leaves 311, 312 is nearly 90 degrees (see FIG. 33).

In a variation of the embodiment, the first acting member 82 and the follower member 84 may be configured such that the cam surface 821 of the first acting member 82 pushes the abutment surface 841 of the follower member 84 so as to move the follower member 84 toward the protrusion 8311 of the hydraulic module 83 when the hinge assemblage is converted from the initial state to the open state, and that the first acting member 82 is rotated relative to the follower member 84 so as to permit the follower member 84 to be moved away from the hydraulic module 83 by the oil spring 86 when the hinge assemblage is converted from the open state to the initial state. Therefore, the hydraulic module 83 is for damping the movement of the follower member 84 when the hinge assemblage is converted from the initial state to the open state.

Figure 34:
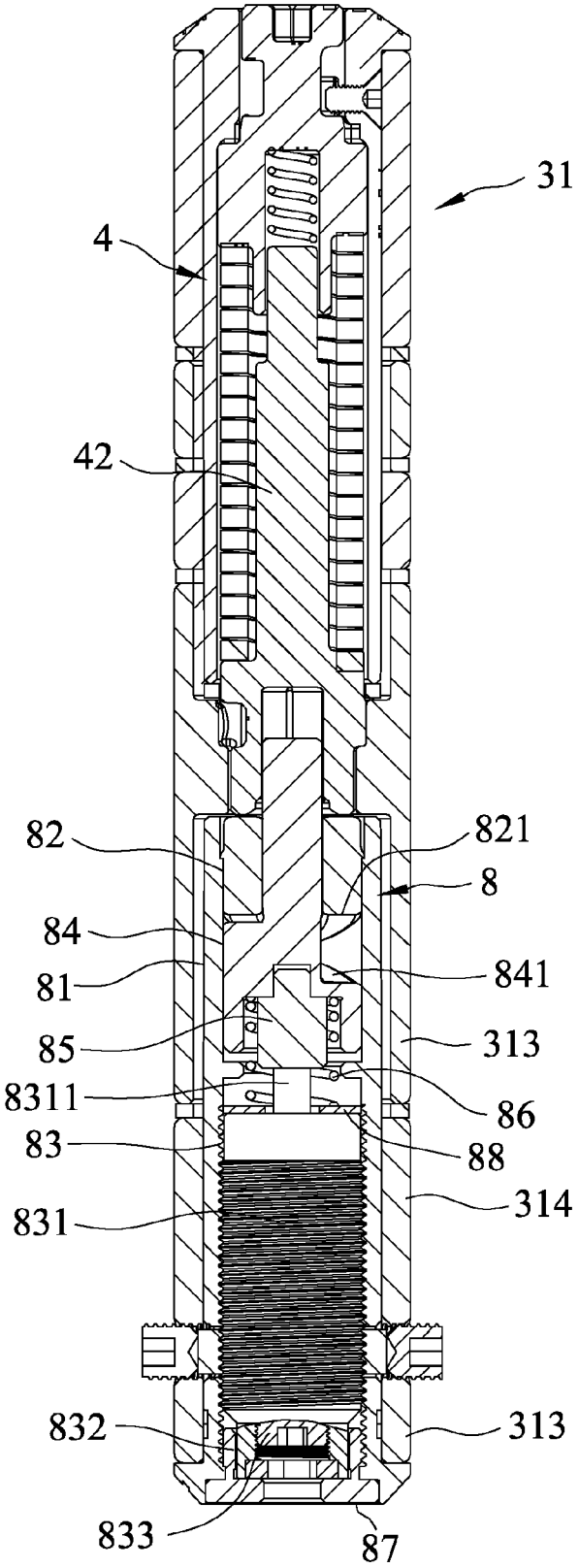
FIG. 34 is a sectional view illustrating a seventh embodiment of the hinge assemblage according to the disclosure.

Referring to FIG. 34, the seventh embodiment of the hinge assemblage according to the disclosure is similar to the first embodiment, and further includes a damping unit 8 to substitute the damping unit 5 (see FIG. 3).

To sum up, the advantages of the disclosure are as follows:

1. The leaf units 31, 32, 33, the hydraulic units 5, 8 and the first and second actuating units 4, 6 of this disclosure are modularized, so that a user can construct a hinge assembly according to particular demand by selecting and assembling suitable ones of the aforesaid units.

2. Since an angle formed between the first and second leaves of the leaf units 31, 32, 33 is 0 degree when the hinge assemblage is at the initial state, the hinge assemblage can only be converted from the initial state. Therefore, whether the first and second objects 21, 22 constitute a right-handed door or a left-handed door, a user can install the hinge assemblage of the disclosure between the first and second objects 21, 22 without confusion.

3. Each of the hydraulic units 5, 8 of this disclosure generates different damping forces in response to the movement of the follower member 56, 84 thereof in different directions. Therefore, the hinge assemblage of this disclosure is subjected to different damping forces when it is converted from the initial state to the open state and when it is converted from the open state to the initial state.

4. Each of the hydraulic units 5, 8 and the first and second actuating units 4, 6 of this disclosure can be manually adjusted without disassembling the corresponding hinge assembly 100, 200, 300. Therefore, the characteristic of the hinge assembly 100, 200, 300 can be easily adjusted.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hinge assemblage adapted for pivotally interconnecting first and second objects, comprising:

a leaf mechanism including a first leaf unit, said first leaf unit including a first leaf adapted to be fixed to the first object, a second leaf adapted to be fixed to the second object and pivotable relative to said first leaf, a plurality of first barrels fixed to said first leaf, and a plurality of second barrels fixed to said second leaf, said first barrels and said second barrels being disposed along an axis in an alternating arrangement, said hinge assemblage being operable to convert between an initial state and an open state, an angle formed between said first and second leaves when said hinge assemblage is in the initial state being different from that angle formed between said first and second leaves when said hinge assemblage is in the open state;

an actuating unit mounted to said first and second barrels of said first leaf unit, and including a tubular member, a connecting axle and an actuating module, said tubular member being co-rotatable with said first leaf and said first barrels of said first leaf unit, said connecting axle extending into said tubular member and being co-rotatable with said second leaf and said second barrels of said first leaf unit, said actuating module being disposed in said tubular member and generating an actuating force during the conversion of said hinge assemblage between the initial and open states; and a damping unit mounted to said first and second barrels of said first leaf unit, and including an oil tube, a first acting member, a follower member and a hydraulic module, said oil tube being co-rotatable with said first leaf and said first barrels of said first leaf unit, said first acting member being disposed fixedly in said oil tube and having an inclined cam surface, said follower member being movable relative to said oil tube along the axis, and having a main body that is disposed in said oil tube and that has a first abutment surface facing toward said cam surface of said first acting member, and a rod section that extends through said first acting member and out of the oil tube to engage said connecting axle of said actuating unit such that said follower member is co-rotatable with said connecting axle of said actuating unit, said follower member being guided by said first acting member to move relative to the oil tube in a first direction during the conversion of said hinge assemblage from the initial state to the open state, and in a second direction opposite to the first direction during the conversion of said hinge assemblage from the open state to the initial state, said hydraulic module being disposed in said oil tube for generating a damping force upon the movement of said follower member relative to said oil tube, said hydraulic module being configured such that the damping force generated by said hydraulic module during the conversion of said hinge assemblage from the initial state to the open state is different from the damping force generated by said hydraulic module during the conversion of said hinge assemblage from the open state to the initial state.

2. The hinge assemblage as claimed in claim 1, wherein said actuating unit further includes a torque-controlling member and a torsion spring that cooperatively serve as said actuating module, said torque-controlling member being disposed adjacent to one end of said tubular member, said connecting axle being disposed adjacent to the other end of said tubular member distal from said torque-controlling member, and having a first end portion that is co-rotatably coupled to said rod section of said follower member, said torsion spring being retained in said tubular member, surrounding said connecting axle, and having two opposite end sections that are respectively connected fixedly to said torque-controlling member and said connecting axle, when external forces are applied to convert said hinge assemblage from the initial state to the open state, said torsion spring being deformed to exert the actuating force so as to generate a resultant restoring torque for converting said hinge assemblage from the open state to the initial state when the external forces are removed.

3. The hinge assemblage as claimed in claim 2, wherein said actuating unit further includes a resilient member, said tubular member further having a plurality of first engaging teeth that are formed on an inner surface thereof and that surround the axis, said connecting axle further having a second end portion that extends into said tubular member, said torque-controlling member having an insertion hole that extends along the axis and that permits said second end portion of said connecting axle to be inserted thereinto, and a plurality of second engaging teeth that are formed on an outer surface thereof and that are removably engaged with said first engaging teeth of said tubular member, said resilient member being disposed in said insertion hole of said torque-controlling member, and having two opposite ends that respectively abut against said torque-controlling member and said second end portion of said connecting axle for resiliently biasing said torque-controlling member and said connecting axle away from each other, said first and second engaging teeth being configured such that said tubular member and said torque-controlling member are co-rotatable when said tubular member is rotated in a first rotational direction or when said torque-controlling member is rotated in a second rotational direction opposite to the first rotational direction, and that said torque-controlling member is rotatable relative to said tubular member so as to adjust the relative position between said first and second engaging teeth when said torque-controlling member is rotated in the first rotational direction.

4. The hinge assemblage as claimed in claim 1, wherein said actuating unit further includes a spring washer assembly, a slide sleeve, a friction member and a brake-conditioning member that cooperatively serve as said actuating module, said friction member being connected fixedly to said tubular member, said slide sleeve being co-rotatably sleeved on said connecting axle, said spring washer assembly being disposed in said tubular member and pushing said slide sleeve against said friction member, said brake-conditioning member engaging threadably said tubular member and pushing said spring washer assembly against said slide sleeve, a frictional force generated between said slide sleeve and said friction member during the conversion of said hinge assemblage between the initial and open states serving as the actuating force for condition of the speed of the relative pivotal movement between said first and second leaves.

5. The hinge assemblage as claimed in claim 4, wherein said actuating unit further includes a pad member and a bolt, one of said first barrels having a first threaded through hole, said tubular member having a second threaded through hole that is registered with said first threaded through hole, said pad member being disposed in said second threaded through hole, said bolt engaging threadably said first threaded through hole and said second threaded through hole to press said pad member against said brake-conditioning member for preventing relative movement between said brake-conditioning member and said tubular member.

6. The hinge assemblage as claimed in claim 1, wherein said damping unit further includes a second acting member and a throttle assembly, said second acting member being disposed in said oil tube at one side of said follower member opposite to said first acting member, and having an inclined cam surface that faces toward said follower member, said main body of said follower member further having a second abutment surface that faces toward said cam surface of said second acting member, said follower member cooperating with said first acting member to define a first oil chamber therebetween, cooperating with said second acting member to define a second oil chamber therebetween, and having a communicating passage that is formed through said main body and said rod section thereof, said first and second oil chambers being filled with oil, said throttle assembly extending along the axis through said first acting member, said second acting member and said communicating passage of said follower member, and cooperating with said follower member to define an oil passageway, said follower member being pushed by said cam surfaces of said first and second acting member to move relative to said oil tube during the conversion of said hinge assemblage between the initial and open states, so as to compress said first oil chamber or said second oil chamber, and to force the oil to flow between said first and second oil chambers via said oil passageway to generate the damping force.

7. The hinge assemblage as claimed in claim 6, wherein said damping unit further includes a cap assembly, a sleeve member and a resilient member, said cap assembly and said sleeve member being respectively mounted to two opposite longitudinal ends of said oil tube, said resilient member having two opposite ends that respectively abut against said second acting member and said follower member.

8. The hinge assemblage as claimed in claim 7, wherein said damping unit further includes a pad member and a bolt, one of said first barrels having a first threaded through hole, said oil tube of said damping unit having a threaded through hole that is registered with said first threaded through hole, said sleeve member having a through hole that is registered with said threaded through hole of said oil tube, said pad member being disposed in said through hole, said bolt engaging threadably said first threaded through hole and said threaded through hole of said oil tube, and extending into said through hole to press said pad member against said throttle assembly.

9. The hinge assemblage as claimed in claim 7, wherein said throttle assembly includes a mounting bolt, a needle, a pin resilient member and a pin, said mounting bolt extending along the axis through said second acting member and engaging threadably said sleeve member, said needle extending along the axis, being rotatably mounted to said mounting bolt, and extending into said rod section of said follower member, said pin resilient member being disposed in said rod section, and having two opposite ends that respective abut against said needle and an inner surface of said rod section, said pin extending along the axis into said rod section of said follower member and said needle, being threadedly secured to said rod section, and cooperating with the needle to define an oil space therebetween, said pin having a conical section that tapers toward said second acting member and that has a tapered annular surface, a space between an outer surface of said needle and said follower member cooperating with a gap between said pin and an inner surface of said needle and said oil space to form a portion of said oil passageway.

10. The hinge assembly as claimed in claim 9, wherein said damping unit further includes a plurality of back-up rings and a plurality of sealing rings, said sealing rings being respectively and fluid-tightly disposed between said mounting bolt and said sleeve member, between said first acting member and said oil tube, between said second acting member and said oil tube, between said follower member and said oil tube, between said first acting member and said rod section of said follower member, and between said second acting member and said mounting bolt, said back-up rings being disposed between said first acting member and said rod section of said follower member to forcibly press against a corresponding one of said sealing rings, and between said second acting member and said mounting bolt to forcibly press against another corresponding one of said sealing rings.

11. The hinge assembly as claimed in claim 9, wherein said cap assembly includes a cap body that is threaded to said oil tube and that permits said rod section of said follower member to extend therethrough, a plurality of back-up rings that are disposed between said cap body and said rod section, and a sealing ring that is disposed between said cap body and said rod section and that is forcibly clamped between said back-up rings for air-tightly sealing a gap between said cap body and said rod section.

12. The hinge assembly as claimed in claim 9 wherein said pin has a conical section that tapers toward said second acting member and that has said tapered annular surface, and a head section that is threadedly secured to said rod section.

13. The hinge assembly as claimed in claim 9, wherein said follower member further has a communicating hole that is formed in said rod section and that fluidly communicates with said communicating passage and said first oil chamber, said needle having a first end portion that is rotatably mounted to said mounting bolt, a second end portion that is opposite to said first end portion and that extends into said rod section of said follower member, a channel that is formed in said second end portion and that permits said pin to be inserted thereinto, two spaced-apart annular clinging surfaces that are formed on an outer surrounding surface of said second end portion and that fluid-tightly cling to said inner surface of said rod section, at least one first communicating hole that is formed in said second end portion and that fluidly communicates with said channel and a space defined between said annular clinging surfaces, and at least one second communicating hole that is formed in said second end portion and that fluidly communicates with said channel and a space defined at one side of said annular clinging surfaces proximate to said first end portion.

14. The hinge assemblage as claimed in claim 9, wherein said damping unit further includes a one-way valve assembly that is disposed in said main body of said follower member and that permits said throttle assembly to extend therethrough, said one-way valve assembly cooperating with said throttle assembly to serve as said hydraulic module, and including a valve seat, two oil passages each extending in the direction of the axis through said valve seat and fluidly communicating with said second oil chamber and a gap between said needle and said valve seat, two valve members each being disposed in a respective one of said oil passages for removably blocking the corresponding oil passage, and two oil resilient members each being disposed in a respective one of said oil passages for resiliently biasing the corresponding valve member toward said first oil chamber so as to block the corresponding oil passage, said gap between said needle and said valve seat forming a portion of said oil passageway, the oil flowing from said first oil chamber through said gap between said needle and said valve seat and through said oil passages of said one-way valve assembly pushing said valve members against said biasing action of said oil resilient members so as to unblock said oil passages, the oil flowing from said second oil chamber into said oil passages of said one-way valve assembly pushing said valve members against said valve seat so as to block said oil passages.

15. The hinge assemblage as claimed in claim 14, wherein said throttle assembly further includes a sleeve piece that is sleeved on said needle, said needle extending through said valve seat of said one-way valve assembly, and having a first end portion that is rotatably mounted to said mounting bolt, a second end portion that is opposite to said first end portion and that extends into said rod section of said follower member, a channel that is formed in said second end portion and that permits said pin to be inserted thereinto so as to define said oil space, and an outer shoulder surface that is formed on said first end portion, said sleeve piece abutting against said mounting bolt and said outer shoulder surface of said needle, and having an outer diameter greater than that of a segment of said first end portion distal from said mounting bolt.

16. The hinge assemblage as claimed in claim 7, wherein said follower member further has an oil path that is formed through said main body and that fluidly communicates with said first and second oil chambers, and an oil groove that is formed in said inner surface of said follower member and that fluidly communicates with said second oil chamber, said throttle assembly including a mounting bolt that extends along the axis through said second acting member and said sleeve member and that engages threadably said sleeve member, a first needle that is movably mounted to said mounting bolt and that extends along the axis into said follower member, a second needle that is disposed in said communicating passage of said follower member and that is threaded to said first needle, a pin that is threaded to said second needle, and a securing member that is threaded to an inner threaded portion of said follower member, said oil passageway being defined between said first needle and said inner surface of said follower member.

17. The hinge assemblage as claimed in claim 16, wherein said damping unit further includes a one-way valve assembly that cooperates with said throttle assembly to serve as said hydraulic module, said one-way valve assembly including a valve member that removably blocks said oil path, and a positioning ring that limits said valve member relative to said follower member such that said valve member is permitted to move within a space defined between said follower member and said positioning ring, the oil in said second oil chamber being prevented from flowing into said oil path by said valve member, the oil flowing from said first oil chamber and through said oil path pushing said valve member so as to unblock said oil path.

18. The hinge assemblage as claimed in claim 1, wherein said damping unit further includes a spacing block and an oil spring, said hydraulic module being disposed at a side of said follower member distal from said first acting member, said spacing block being disposed between said hydraulic module and said follower member, said oil spring resiliently biasing said follower member toward said first acting member.

19. The hinge assemblage as claimed in claim 18, wherein said damping unit further includes a cap that is mounted to an end of said oil tube, said spacing block being connected fixedly to said follower member, said hydraulic module including a main body that is movably threaded within said oil tube, a sleeve that is connected fixedly to an end of said main body distal from said first acting member, and an adjusting bolt that engages threadably said sleeve, said main body having a protrusion that protrudes toward said first acting member for being depressed by said spacing block such that said main body generates a damping force upon the depression of said protrusion, said sleeve being operable to move said main body relative to said oil tube so as to adjust a distance between said protrusion and said first acting member, said adjusting bolt being operable to move relative to said sleeve so as to adjust said damping coefficient of said main body and to adjust the magnitude of the damping force generated by said main body upon the depression of said protrusion.

20. The hinge assemblage as claimed in claim 1, further comprising two additional actuating units, said leaf mechanism further including a second leaf unit, said second leaf unit including a first leaf adapted to be fixed to the first object, a second leaf adapted to be fixed to the second object and pivotable relative to said first leaf, a plurality of first barrels fixed to said first leaf, and a plurality of second barrels fixed to said second leaf, said first barrels and said second barrels being disposed along the axis in an alternating arrangement, each of said additional actuating units being mounted to said first and second barrels of said second leaf unit, and including a tubular member that is co-rotatable with said first leaf and said first barrels of said second leaf unit, a connecting axle that extends into an end of said tubular member and that is co-rotatable with said second leaf and said second barrels of said second leaf unit, a torque-controlling member that is disposed at the other end of said tubular member distal from said connecting axle, and a torsion spring, said torque-controlling member and said torsion spring of each of said additional actuating units cooperatively serving as an actuating module, said connecting axle of each of said additional actuating units having a first end portion that is co-rotatably coupled to said first end portion of said connecting axle of the other one of said additional actuating units, said torsion spring of each of said additional actuating units being retained in the corresponding tubular member, surrounding the corresponding connecting axle, and having two opposite end sections that are respectively fixed to the corresponding torque-controlling member and the corresponding connecting axle, said torsion springs of said additional actuating units being respectively configured as right-hand and left-hand coil springs, when external forces are applied to convert said hinge assemblage from the initial state to the open state, said torsion spring of each of said additional actuating units being deformed to exert a restoring force so as to generate a resultant restoring torque for converting said hinge assemblage from the open state to the initial state when the external forces are removed.

21. The hinge assemblage as claimed in claim 20, wherein each of said additional actuating units further includes a resilient member, said tubular member of each of said additional actuating units further having a plurality of first engaging teeth that are formed on an inner surface thereof and that surround the axis, said connecting axle of each of said additional actuating units further having a second end portion that extends into said corresponding tubular member, said torque-controlling member of each of said additional actuating units having an insertion hole that extends along the axis and that permits said second end portion of said corresponding connecting axle to be inserted thereinto, and a plurality of second engaging teeth that are formed on an outer surface thereof and that are removably engaged with said first engaging teeth of said corresponding tubular member, said resilient member of each of said additional actuating units being disposed in said insertion hole of said corresponding torque-controlling member, and having two opposite ends that respectively abut against said corresponding torque-controlling member and said second end portion of said corresponding connecting axle, for each of said additional actuating units, said first and second engaging teeth being configured such that said tubular member and said torque-controlling member are co-rotatable when said tubular member is rotated in a first rotational direction or when said torque-controlling member is rotated in a second rotational direction opposite to the first rotational direction, and that said torque-controlling member is rotatable relative to said tubular member so as to adjust the relative position between said first and second engaging teeth when said torque-controlling member is rotated in the first rotational direction.

22. The hinge assemblage as claimed in claim 1, further comprising an additional first actuating unit and an additional second actuating unit, said leaf mechanism further including an additional leaf unit, said additional leaf unit including a first leaf adapted to be fixed to the first object, a second leaf adapted to be fixed to the second object and pivotable relative to said first leaf, a plurality of first barrels fixed to said first leaf, and a plurality of second barrels fixed to said second leaf, said first barrels and said second barrels being disposed along the axis in an alternating arrangement, said additional first actuating unit being mounted to said first and second barrels of said additional leaf unit, and including a first tubular member that is co-rotatable with said first leaf and said first barrels of said additional leaf unit, a first connecting axle that extends into an end of said first tubular member and that is co-rotatable with said second leaf and said second barrels of said additional leaf unit, a first torque-controlling member that is disposed at the other end of said first tubular member distal from said first connecting axle, and a torsion spring, said first torque-controlling member and said torsion spring of said additional first actuating unit cooperatively serving as an actuating module, said first connecting axle of said first actuating unit having a first end portion that is co-rotatably coupled to one of said second barrels of said additional leaf unit, said torsion spring of said additional first actuating units being retained in said first tubular member, surrounding said first connecting axle of said first additional actuating unit, and having two opposite end sections that are respectively fixed to said first torque-controlling member and said first connecting axle, said additional second actuating unit including a second tubular member that is mounted to said first and second barrels of said additional leaf unit and that is co-rotatable with said first leaf and said first barrels of said additional leaf unit, a second connecting axle that is co-rotatably coupled to said first connecting axle of said additional first actuating unit, a friction member that is connected fixedly to said second tubular member and that permits said second connecting axle to extend therethrough, a slide sleeve that is co-rotatably sleeved on said connecting axle, a spring washer assembly that is disposed in said second tubular member and that pushes said slide sleeve against said friction member, and a brake-conditioning member that engages threadably said second tubular member and that pushes said spring washer assembly against said slide sleeve, said spring washer assembly cooperating with said slide sleeve, said friction member and said brake-conditioning member of said additional second actuating unit to serve as said actuating module, when external forces are applied to convert said hinge assemblage from the initial state to the open state, said torsion spring of said additional first actuating unit being deformed to exert a restoring force so as to generate a resultant restoring torque for converting said hinge assemblage from the open state to the initial state when the external forces are removed, a frictional force generated between said slide sleeve and said friction member during the conversion of said hinge assemblage between the initial and open states serving as an actuating force for condition of the speed of the relative pivotal movement between said first and second leaves.

23. The hinge assemblage as claimed in claim 22, wherein said additional second actuating unit further includes a pad member and a bolt, one of said first barrels of said additional leaf unit having a first threaded through hole, said second tubular member of said additional second actuating unit having a second threaded through hole that is registered with said first threaded through hole, said pad member being disposed in said second threaded through hole, said bolt engaging threadably said first threaded through hole and said second threaded through hole to press said pad member against said brake-conditioning member for preventing relative movement between said brake-conditioning member and said second tubular member.

24. The hinge assemblage as claimed in claim 22, wherein said additional first actuating unit further includes a first resilient member, said first tubular member further having a plurality of first engaging teeth that are formed on an inner surface thereof and that surround the axis, said first connecting axle further having a second end portion that extends into said first tubular member, said first torque-controlling member having an insertion hole that extends along the axis and that permits said second end portion of said first connecting axle to be inserted thereinto, and a plurality of second engaging teeth that are formed on an outer surface thereof and that are removably engaged with said first engaging teeth of said first tubular member, said first resilient member being disposed in said insertion hole of said first torque-controlling member, and having two opposite ends that respectively abut against said first torque-controlling member and said second end portion of said first connecting axle for resiliently biasing said first torque-controlling member and said first connecting axle away from each other, said first and second engaging teeth being configured such that said first tubular member and said first torque-controlling member are co-rotatable when said first tubular member is rotated in a first rotational direction or when said first torque-controlling member is rotated in a second rotational direction opposite to the first rotational direction, and that said first torque-controlling member is rotatable relative to said first tubular member so as to adjust the relative position between said first and second engaging teeth when said first torque-controlling member is rotated in the first rotational direction.

* * * * *